US006749289B2

(12) United States Patent
Matsumoto et al.

(10) Patent No.: US 6,749,289 B2
(45) Date of Patent: Jun. 15, 2004

(54) LIQUID EJECTION APPARATUS AND INKJET PRINTER, AND METHOD OF MANUFACTURING THEM

(75) Inventors: Nobuo Matsumoto, Kanagawa (JP); Masao Mitani, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/102,018

(22) Filed: Mar. 21, 2002

(65) Prior Publication Data

US 2002/0180840 A1 Dec. 5, 2002

(30) Foreign Application Priority Data

Mar. 22, 2001 (JP) ..... 2001-082494

(51) Int. Cl.[7] ..... B41J 2/05
(52) U.S. Cl. ..... 347/63; 347/65
(58) Field of Search ..... 347/20, 56, 61, 347/63, 65; 29/890.1, 611; 216/27

(56) References Cited

U.S. PATENT DOCUMENTS 5,441,593 A * 8/1995 Baughman et al. ..... 347/65
5,666,140 A 9/1997 Mitani et al. ..... 347/12

FOREIGN PATENT DOCUMENTS

JP 06-297714 A 10/1994 ..... B41J/2/05

* cited by examiner

*Primary Examiner*—Juanita Stephens
(74) *Attorney, Agent, or Firm*—Whitham, Curtis & Christofferson, P.C.

(57) ABSTRACT

The liquid ejection apparatus includes nozzles formed in a member provided on one side of a substrate, droplet ejection units each of which corresponds to one of the nozzles, and which are formed on a surface of the one side of the substrate, individual flow paths each of which feeds liquid to one of the nozzles, and which are formed on the one side of the substrate, one or more front surface feed paths for feeding liquid correspondingly to the individual flow paths and one or more back surface feed paths communicating with the one or more front surface feed paths. The one or more front surface feed paths are formed by etching process from the surface of the one side of the substrate and the one or more back surface feed paths are formed by sandblast process from a surface of another side of the substrate. The inkjet printer includes the liquid ejection apparatus as the inkjet print head.

22 Claims, 8 Drawing Sheets

LIQUID EJECTION APPARATUS AND INKJET PRINTER, AND METHOD OF MANUFACTURING THEM

BACKGROUND OF THE INVENTION

The present invention belongs to the technical field of liquid ejection apparatus utilized in inkjet recording heads, etc. and, more particularly, relates to a liquid ejection apparatus that is high in production efficiency and yield and, in addition, can realize ejection of liquid droplets with a high accuracy, a method of manufacturing this liquid ejection apparatus, an inkjet printer utilizing this liquid ejection apparatus, and a method of manufacturing this inkjet printer.

Thermal inkjet formed in such a manner that a portion of ink is rapidly vaporized by heating by the use of a heater, so that, by the expansion force thereof, etc., ink droplets are ejected from nozzles, is utilized in various printers (See JP 48-9622 A, JP 54-51837 A, etc.).

Further, there is also known a printer that utilizes an electrostatic type inkjet formed in such a manner that a diaphragm (vibration plate) is vibrated by static electricity, so that, by the energy thereof, ink droplets are ejected from nozzles (See JP 11-309850 A, etc.).

FIGS. 9A and 9B are schematic diagrams showing an example of a recording head of so-called top shooter type using thermal inkjet, which is one of such inkjets. Of FIGS. 9A and 9B, FIG. 9A is a view (hereinafter referred to as a plan view) of the recording head as seen from the ink ejection direction, while FIG. 9B is a sectional view taken along the line IV—IV in FIG. 9A.

As shown in FIG. 9A, in a recording head 150, a large number of nozzles 20 for ejecting the ink are formed in a state arranged in one direction (the direction perpendicular to the drawing plane of FIG. 9B). Further, in the example shown, two rows of such nozzles 20 (hereinafter referred to as nozzle rows) are provided, whereby the recording density is enhanced.

In this recording head 150, heaters (not shown) as ink ejection devices corresponding to the individual nozzles 20 and driving integrated circuits 14 for driving the respective heaters are formed on an Si (silicon) substrate 12, and further, on them, a partition wall 15 that defines individual ink flow paths to the respective nozzles 20 (heaters) and the like are laminated. Further, the nozzles 20 are formed through an orifice plate 22 laminated/stuck on the partition wall 15.

Further, in the Si substrate 12 of the recording head 150, there are formed an ink groove 152 for feeding the ink to the individual ink flow paths for a plurality of nozzles 20 and ink feed holes 154 for feeding the ink to this ink groove 152. The ink groove 152 is formed by digging down in the surface of the Si substrate 12 so as to extend in the direction of the nozzle rows, while the ink feed holes 154 are bored so as to be arranged at predetermined intervals in the nozzle row direction in a state connecting the back surface of the Si substrate 12 and the ink groove 152 to each other.

The recording head 150 as such is normally not handled in the state of the Si chip comprised mainly of the Si substrate 12, but it is mounted in a frame 24 and fitted into a head unit (e.g., a so-called cartridge) or the like of an inkjet printer.

In the frame 24, there is formed an ink flow path 26 for feeding the ink fed from an ink tank connected to the head unit to the ink feed holes 154 in the recording head 150.

In the recording head 150, the ink fed from the ink flow path 26 in the frame 24 flows into the ink feed holes 154 from the back surface side of the Si substrate 12, and then, the ink is introduced into the ink groove 152 communicating with the ink feed holes 154, flows from the ink groove 152 into the individual ink flow paths defined by the partition wall 15 so as to lead to the respective nozzles 20, and is ejected from the nozzles 20 by the heating of the heaters.

The recording head 150 in which ink ejection devices such as heaters (the devices include diaphragms for an inkjet printer of electrostatic type as referred to above apart from heaters for a thermal inkjet printer whose recording head is illustrated in the figures) are formed on the Si substrate 12 can be fabricated by employing the semiconductor manufacturing technology which utilizes film deposition techniques and photolithography.

In the recording head 150 of top shooter type as illustrated in the figures, the provision of ink feed flow paths extending through the Si substrate 12 is indispensable; ordinarily, the ink groove 152 for feeding the ink to the individual ink flow paths for the respective nozzles and the ink feed holes 154 for feeding the ink to the ink groove 152 from the back surface of the Si substrate 12 are formed as illustrated in the figures.

As the methods for the formation of the ink groove 152 and the ink feed holes 154 as such, there are known the etching process, the laser machining process, the sandblasting process, etc, any of which can be used for the processing of the Si substrate 12.

However, in case of the etching of an Si substrate, both the wet etching and the dry etching are excellent in processing accuracy but have the drawback that their processing efficiency is inferior.

The laser machining has problems that both its processing efficiency and processing accuracy are low and it requires much time since the splashes (work tailings) produced after machining need to be removed.

The sandblast is superior in processing efficiency indeed but it is disadvantageous because its processing accuracy is low and there is even a high possibility that damages such as the breakdown of the Si substrate 12 at the edges of the ink groove 152 be caused, for example, as shown in FIG. 9B since it is a grinding process utilizing impact. There is another disadvantage that, in case such damages exist, the flow of the ink does not become uniform, so that it becomes impossible to stably feed a correct amount of ink to each nozzle 20, and in addition, through the damaged portions, the ink penetrates to break the driving integrated circuits 14, etc. formed on the Si substrate 12 in some cases.

Further, the formation of the ink groove 152, etc. is normally made after the fabrication of the driving integrated circuits 14, etc., but, in case of using the sandblast process, static electricity is produced during processing, so that the insulating layers of the driving integrated circuits 14 are charged with the electricity, whereby the driving integrated circuits 14, etc. are subjected to electrostatic breakdown in some cases.

Thus, the sandblast is good in processing efficiency but has problems of its low processing accuracy and low production yield.

SUMMARY OF THE INVENTION

It is the object of the present invention to give solutions to the foregoing problems of the known art and, more particularly, to provide a liquid ejection apparatus used in an inkjet recording head or the like that is constituted in such a manner that liquid ejection units such as vibration plates vibrated by static electricity, heaters or the like are formed on a substrate composed of Si or the like, said liquid ejection apparatus having a good productivity and a good production yield, and the necessary portions thereof having a high accuracy, to provide a method of manufacturing this liquid ejection apparatus, to provide an inkjet printer using this liquid ejection apparatus as an inkjet recording head, and to provide a method of manufacturing this inkjet printer.

In order to attain the object described above, the first aspect of the present invention provides a liquid ejection apparatus comprising: a substrate having one side and another side; a plurality of nozzles formed in a member provided on the one side of the substrate; a plurality of droplet ejection units, each corresponding to one of the plurality of nozzles, the plurality of droplet ejection units being formed on a surface of the one side of the substrate; a plurality of individual flow paths, each feeding liquid to one of the plurality of nozzles, the plurality of individual flow paths being formed on the one side of the substrate; one or more front surface feed paths for feeding liquid correspondingly to the plurality of individual flow paths, the one or more front surface feed paths being formed by etching process from the surface of the one side of the substrate; and one or more back surface feed paths communicating with the one or more front surface feed paths, the one or more back surface feed paths being formed by sandblast process from a surface of the another side of the substrate.

Preferably, the plurality of individual flow paths are defined by a plurality of partition walls separating the plurality of nozzles from one another, the plurality of partition walls being formed on the one side of the substrate; and the plurality of nozzles are each bored in a member laminated on the plurality of partition walls and an expression: $5H+h \geqq L \geqq 2H+h$ [wherein H stands for a height of each of the plurality of partition walls, h stands for a length of each of the plurality of nozzles, and L stands for a distance from an end portion of the one or more front surface feed paths that is toward each of the plurality of individual flow paths to each of the plurality of droplet ejection units] is satisfied while H is 6 $\mu$m or less and h is 10 $\mu$m or less.

Preferably, a thickness of the substrate is 600 $\mu$m or more and a depth of each of the one or more front surface By feed paths is 20 $\mu$m to 400 $\mu$m.

Preferably, the liquid is ejected in a direction approximately perpendicular to a surface of the substrate.

The first aspect of the present invention provides a liquid ejection apparatus comprising: a substrate having one side and another side; a plurality of nozzles formed in a member provided on the one side of the substrate; and one or more liquid feed paths formed by sandblast process from a surface of the another side of the substrate opposite to the one side on which the plurality of nozzles are located, and formed by etching process from the surface of the one side of the substrate on which the plurality of nozzles are located.

It is preferable that the liquid ejection apparatus, further comprises a plurality of droplet ejection units, each corresponding to each of the plurality of nozzles, the plurality of droplet ejection units being formed on the surface of the one side of the substrate on which the plurality of nozzles are located; and a plurality of liquid flow paths for feeding liquid to each of the plurality of nozzles, the plurality of liquid flow paths being defined by one or more partition walls separating the plurality of nozzles from one another.

Preferably, the plurality of nozzles are bored in a member laminated on the one or more partition walls; the one or more liquid feed paths comprise one or more first feed paths formed by the etching process in the substrate and one or more second feed paths formed by the sandblast process in the substrate; and an expression: $5H+h \geqq L \geqq 2H+h$ [wherein H stands for a height of the one or more partition walls, h stands for a length of the plurality of nozzles, and L stands for a length of the one or more first feed paths] is satisfied while H is 6 $\mu$m or less and h is 10 $\mu$m or less.

In order to attain the object described above, the second aspect of the present invention provides a method of manufacturing a liquid ejection apparatus which comprises: a substrate having one side and another side; a plurality of nozzles formed in a member provided on the one side of the substrate; a plurality of droplet ejection units, each corresponding to one of the plurality of nozzles, the plurality of droplet ejection units being formed on a surface of the one side of the substrate; a plurality of individual flow paths, each feeding liquid to one of the plurality of nozzles, the plurality of individual flow paths being formed on the one side of the substrate; one or more front surface feed paths for feeding liquid to the plurality of individual flow paths; and one or more back surface feed paths for feeding liquid to the one or more front surface feed paths, the method comprising: forming the one or more back surface feed paths by sandblast process from a surface of the another side of the substrate; and forming the one or more front surface feed paths by etching process from the surface of the one side of the substrate, thereby making the one or more back surface feed paths and the one or more front surface feed paths communicate with each other through the substrate.

Preferably, the one or more front surface feed paths are formed by the etching process after the one or more back surface feed paths are formed by the sandblast process.

Preferably, the one or more back surface feed paths are formed in the substrate, which is in a grounded state, after the plurality of droplet ejection units and driving devices for driving the plurality of droplet ejection units are formed on the substrate.

In order to attain the object described above, the third aspect of the present invention provides an inkjet printer comprising an ink ejection apparatus which includes: a substrate having one side and another side; a plurality of nozzles formed in a member provided on the one side of the substrate; a plurality of ink droplet ejection units, each corresponding to one of the plurality of nozzles, the plurality of ink droplet ejection units being formed on a surface of the one side of the substrate; a plurality of individual flow paths, each feeding ink to one of the plurality of nozzles, the plurality of individual flow paths being formed on the one side of the substrate; one or more front surface feed paths for feeding ink correspondingly to the plurality of individual flow paths, the one or more front surface feed paths being formed by etching process from the surface of the one side of the substrate; and one or more back surface feed paths communicating with the one or more front surface feed paths, the one or more back surface feed paths being formed by sandblast process from a surface of the another side of the substrate.

Preferably, the plurality of individual flow paths are defined by a plurality of partition walls separating the plurality of nozzles from one another, the plurality of partition walls being formed on the one side of the substrate; the plurality of nozzles are each bored in a member laminated on the plurality of partition walls; and an expression: $5H+h \geqq L \geqq 2H+h$ [wherein H stands for a height of each of the plurality of partition walls, h stands for a length of each of the plurality of nozzles, and L stands for a distance from an end portion of the one or more front surface feed paths that is toward each of the plurality of individual flow paths to each of the plurality of ink droplet ejection units] is satisfied while H is 6 μm or less and h is 10 μm or less.

Preferably, a thickness of the substrate is 600 μm or more and a depth of each of the one or more front surface feed paths is 20 μm to 400 μm.

Preferably, the ink is ejected in a direction approximately perpendicular to a surface of the substrate.

The third aspect of the present invention provides an inkjet printer comprising an ink ejection apparatus which includes: a substrate having one side and another side; a plurality of nozzles formed in a member provided on the one side of the substrate; and one or more ink feed paths formed by sandblast process from a surface of the another side of the substrate opposite to the one side on which the plurality of nozzles are located, and formed by etching process from the surface of the one side of the substrate on which the plurality of nozzles are located.

Preferably, the ink ejection apparatus further comprises: a plurality of ink droplet ejection units, each corresponding to each of the plurality of nozzles, the plurality of ink droplet ejection units being formed on the surface of the one side of the substrate on which the plurality of nozzles are located; and a plurality of ink flow paths for feeding ink to each of the plurality of nozzles, the plurality of ink flow paths being defined by one or more partition walls separating the plurality of nozzles from one another.

Preferably, the plurality of nozzles are bored in a member; laminated on the one or more partition walls; the one or more ink feed paths comprise one or more first feed paths formed by the etching process in the substrate and one or more second feed paths formed by the sandblast process in the substrate; and an expression: $5H+h \geqq L \geqq 2H+h$ [wherein H stands for a height of the one or more partition walls, h stands for a length of the plurality of nozzles, and L stands for a length of the one or more first feed paths] is satisfied while H is 6 μm or less and h is 10 μm or less.

In order to attain the object described above, the fourth aspect of the present invention provides a method of manufacturing an inkjet printer comprising an ink ejection apparatus which includes: a substrate having one side and another side; a plurality of nozzles formed in a member provided on the one side of the substrate; a plurality of ink droplet ejection units, each corresponding to one of the plurality of nozzles, the plurality of ink droplet ejection units being formed on a surface of the one side of the substrate; a plurality of individual flow paths, each feeding ink to one of the plurality of nozzles, the plurality of individual flow paths being formed on the one side of the substrate; one or more front surface feed paths for feeding ink to the plurality of individual flow paths; and one or more back surface feed paths for feeding ink to the one or more front surface feed paths, the method comprising: forming the one or more back surface feed paths by sandblast process from a surface of the another side of the substrate; and forming the one or more front surface feed paths by etching process from the surface of the one side of the substrate, thereby making the one or more back surface feed paths and the one or more front surface feed paths communicate with each other through the substrate.

Preferably, the one or more front surface feed paths are formed by the etching process after the one or more back surface feed paths are formed by the sandblast process.

Preferably, the one or more back surface feed paths are formed in the substrate, which is in a grounded state, after the plurality of ink droplet ejection units and driving devices for driving the plurality of ink droplet ejection units are formed in the substrate.

BRIEF DESCRIPTION OF THE DRAWINGS

FIGS. 1A and 1B are schematic diagrams showing an embodiment of the inkjet recording head according to the present invention, of which FIG. 1A is a plan view, and FIG. 1B is a sectional view taken along the line I—I in FIG. 1A.

FIGS. 7A and 7B are schematic diagrams showing another embodiment of the inkjet recording head according to the present invention, of which FIG. 7A is a schematic sectional view taken along the direction of nozzle arrangement and FIG. 7B is a schematic sectional view taken along the direction orthogonal to the nozzle arrangement direction.

FIGS. 9A and 9B are schematic diagrams of a conventional inkjet recording head, of which FIG. 9A is a plan view, and FIG. 9B is a sectional view taken along the line IV—IV in FIG. 9A.

DETAILED DESCRIPTION OF THE INVENTION

Figure 1A:
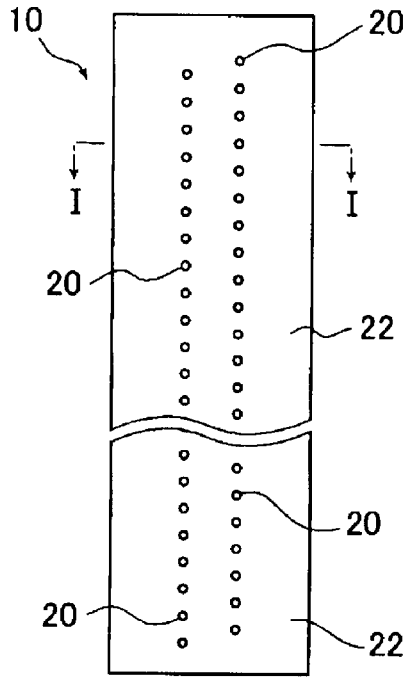

The liquid ejection apparatus, the method of manufacturing this liquid ejection apparatus, the inkjet printer using this liquid ejection apparatus, and the method of manufacturing this inkjet printer according to the present invention will be described in detail on the basis of the preferred embodiments shown in the accompanying drawings.

The following description will be made with respect to the embodiments where the liquid ejection apparatus according to the present invention is used for an inkjet recording head of the so-called thermal inkjet type constituted in such a manner that, by the heating effected by heaters, the nuclear boiling of ink is caused, so that the ink droplets are ejected by the expansion force and the burst force thereof.

However, the present invention is not limited to such embodiments; the invention can be suitably applied to various uses, other than the use in an inkjet recording head, so long as there is employed a structure in which liquid ejection devices such as heaters, and vibration plates vibrated by static electricity or magnetic force are formed on a substrate.

Further, the substrate is not limited, either, to the Si (silicon) substrate used in the examples shown, but various other types are usable; suitable examples of the substrate include substrates composed of Si compounds, various metals (including alloys and metal compounds), ceramics, and glass.

As for the utilization of the liquid ejection apparatus of the present invention for an inkjet recording head as in case of the examples shown, the apparatus can be utilized not only for a thermal inkjet recording head as in case of the examples shown but also for various other types of inkjet recording heads. For example, the liquid ejection apparatus of the present invention can also be suitably utilized for an inkjet recording head of the static electricity type or the like constituted in such a manner that ink chambers that have nozzles formed are provided, and one wall surface of each said ink chambers is constituted as a vibration plate, so that the vibration plate is vibrated by static electricity or magnetic force, and, by the vibration energy thereof, the ink is ejected from the nozzle, and the ink is made flow into the ink chamber.

The inkjet recording head according to the present invention may be used as a small-sized inkjet recording head associated with a serial type printer that is moved for scanning by a carriage in a direction perpendicular to the nozzle row in combination with the intermittent conveyance of paper for inkjet recording or image receiving paper (hereinafter simply referred to as recording paper), or again, a so-called line head constituted in such a manner that the nozzle row extends corresponding to the whole region (or a region exceeding it) of one side of recording paper.

Further, the inkjet recording heads as illustrated in figures are those of so-called top shooter (face inkjet) type which eject ink in a direction approximately perpendicular to the surface of the Si substrate, but the inkjet recording head according to the present invention may also be that of side shooter (edge inkjet) type which ejects ink in a direction approximately parallel to the surface of the Si substrate.

In case of the top shooter type inkjet recording head and, particularly, that employing the center feed system in which nozzles can be disposed at both sides of the front surface ink feed path (corresponding to an ink groove 16 of the example shown in FIG. 1), the provision of ink feed paths formed through the Si substrate (corresponding to the ink groove 16 and ink feed holes 18 of the example shown in FIG. 1) is indispensable. Due to this, the present invention is particularly suitable to the inkjet recording head of top shooter type employing the center feed system.

Figure 1B:
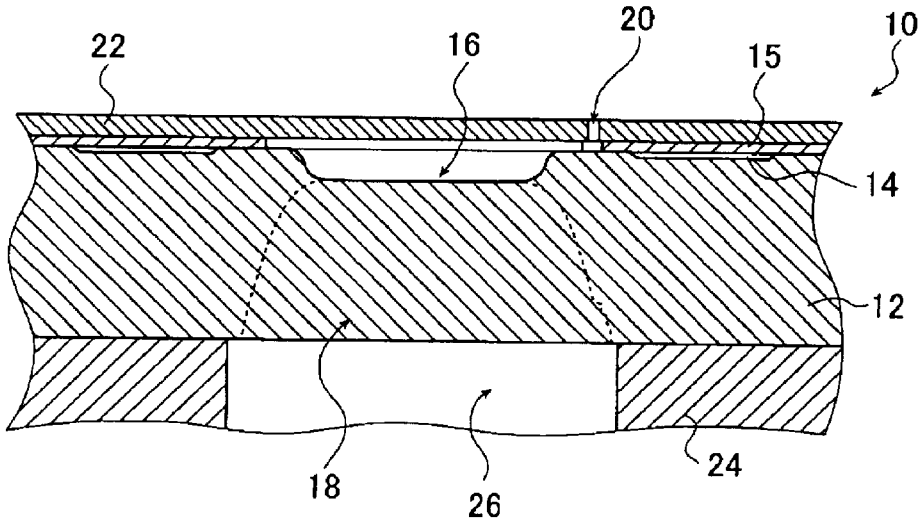

FIGS. 1A and 1B are schematic diagrams showing an embodiment of the inkjet recording head according to the present invention, of which FIG. 1A is a view (plan view) of the inkjet recording head as seen from the ink ejection (flying) side, and FIG. 1B is a sectional view taken along the line I—I in FIG. 1A.

Figure 9A:
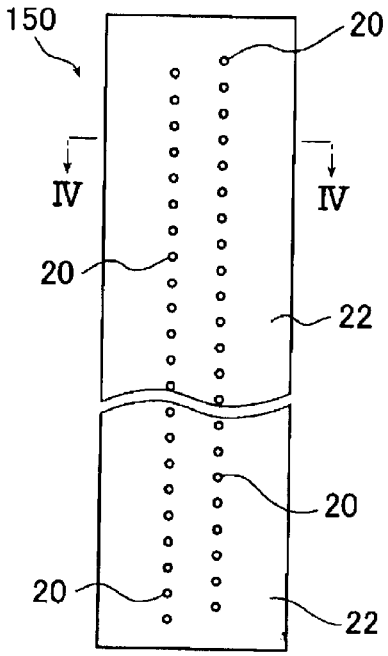
FIG. 9A PRIOR ART
Figure 9B:
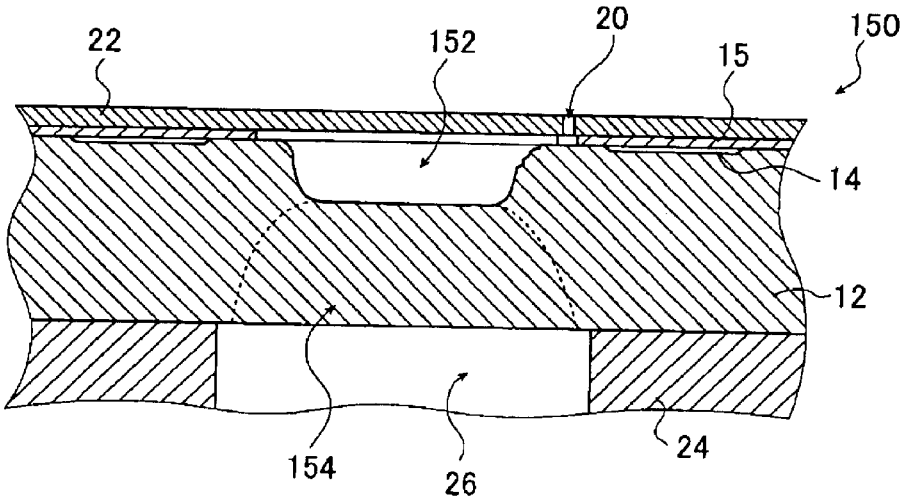
FIG. 9B PRIOR ART

The inkjet recording head 10 (hereinafter referred to as the recording head 10) shown in FIGS. 1A and 1B is for the most part identical with the recording head 150 shown in above-mentioned FIGS. 9A and 9B, so that the same portions as those shown in FIGS. 9A and 9B will be referenced by the same reference numerals, and the portions different from those shown in FIG. 9 will mainly be described below.

As in case of the recording head 150 shown in above-mentioned FIGS. 9A and 9B, the recording head 10 is constituted in such a manner that a large number of nozzles 20 for ejecting the ink are arranged in one direction (the direction perpendicular to the drawing plane of FIG. 1B), and these nozzles 20 are provided in two rows (hereinafter referred to as nozzle rows), whereby the recording density is enhanced.

The recording head 10 according to the present invention is not limited to the provision of nozzles in two rows, but the nozzles may alternatively be provided in one row, or three or more nozzle rows may be provided. The colors of the ink ejected from the respective nozzle rows and the combination of colors can be arbitrarily determined.

In the recording head 10 as the shown example, heaters (refer to the reference numeral 36 in FIG. 2), heater-driving integrated circuits 14, etc. are likewise formed on the surface of one side of an Si (silicon) substrate 12 (Si wafer), and further, on these elements, there is laminated a partition wall 15 that defines the individual ink flow paths (refer to the reference numeral 48 in FIG. 2) for the respective nozzles 20 (heaters). In the present invention, the surface of the side of the Si substrate 12 on which side the heaters, etc. are formed is referred to as the front surface, while the surface of the side opposite to the above side (namely, another side) is referred to as the back surface.

As in case of the foregoing known example, in the Si substrate 12, there are formed an ink groove 16 for feeding the ink to all of the individual ink flow paths (individual ink flow paths 48 to be described below) each for one of a plurality of nozzles 20, and ink feed holes 18 for feeding the ink to the ink groove 16.

The ink groove 16 is formed by digging down in the surface of the Si substrate 12 so as to extend over the whole region of the nozzle rows, while on the other hand, a plurality of ink feed holes 18 are bored at predetermined intervals in the direction of the nozzle rows in a state extending through the Si substrate 12 from its back surface so as to communicate with the ink groove 16 as in case of the known example.

In the shown example, one ink groove 16 is provided for feeding the ink to all of the individual ink flow paths individually associated with all the nozzles 20. However, the present invention is not limited to this structure, but may alternatively be constituted in such a manner that at least one set of a plurality of ink grooves divided in the direction of the nozzle rows and a plurality of ink grooves approximately parallel to the nozzle row direction is provided, and the respective ink grooves feed the ink to a plurality of individual ink flow paths in different regions.

Further, the back surface feed paths for feeding the ink to the ink groove 16 are not limited to the ink feed holes 18 formed at predetermined intervals in the nozzle row direction as in case of the shown example, but may be formed as a slit-shaped feed path, instead of hole-shaped feed paths, which extends in the nozzle row direction.

In the recording head 10 according to the present invention, the ink groove 16 is formed from the front surface side of the Si substrate 12 by etching of Si (either the anisotropic or isotropic etching may alike be employed), while the ink feed holes 18 are formed by sandblast from the back surface side.

As mentioned above, in case of the recording head 10 of top shooter type employing the center feed system, the provision of ink feed paths extending through the Si substrate 12 is indispensable; ordinarily, as in case of the shown example, the ink groove 16 (front surface feed path) for feeding the ink correspondingly to the individual ink flow paths (48) for a plurality of nozzles 20 (all the nozzles 20 in case of the shown example) and the ink feed holes 18 (back surface feed paths) for feeding the ink to the ink groove 16 from the back surface side are formed.

The formation of such an ink groove and ink feed holes is made ordinarily by the use of various processing methods such as the etching process, the laser machining process, the sandblasting process, etc, any of which can be used for the processing of Si substrate but has some problem or another such as of a poor processing efficiency, a low processing accuracy, and much time being required, as stated before.

In contrast, in the recording head 10 of the present invention, the ink feed holes 18 are formed by sandblast from the back surface of the Si substrate 12, and the ink groove 16 is formed from the front surface of the Si substrate 12 by etching of Si.

More specifically, according to the present invention, the ink feed holes 18, which require a large amount of processing (large processing depth) while requiring not so high a processing accuracy, are formed by the sandblast process that has a good processing efficiency, and the ink groove 16, which requires a high processing accuracy while requiring only a small amount of processing, is formed by the Si etching process that has a good processing accuracy.

In the recording head 10 according to the present invention, due to the above-mentioned constitution thereof, a good processing efficiency is secured and, in addition, the ink groove 16 that requires a high processing accuracy can be made free from the break or other damage of the edges thereof and with a sufficiently high accuracy. Further, the ink groove 16 ordinarily has a depth of about 100 $\mu$m, so that the fall in processing efficiency is small as a whole even when the etching process is used.

In addition, the ink groove 16 formed by etching is free from the break or other damage of the edges thereof and, moreover, has good surface property and state, so that the uniformity in flow of the ink to the respective nozzles 20 (individual flow paths 48) is good, and the image quality is also excellent. Further, since the ink groove 16 can be formed with a high accuracy, the distance between the ink groove 16 and the heaters can be shortened, and thus, the ink may be ejected in an extremely small amount and at an enhanced frequency.

In case of etching, no static electricity is produced, and sandblast can be performed from the back surface of the Si substrate 12 preferably in a grounded state, so that the front surface side of the substrate, on which the driving integrated circuits 14, etc. are formed, is not charged with static electricity, and thus, the static breakdown of the driving integrated circuits 14 can be prevented.

Thus, the recording head 10 (liquid ejection apparatus) of the present invention is a recording head that has such excellent characteristics that it can perform a high-speed image recording with a high accuracy and a high image quality, and in addition, the processibility (i.e., productivity) and production yield thereof are both good.

With reference to the recording head 10 of the present invention, no particular limitation is placed on the method of performing the sandblast for processing the Si substrate 12 from the back surface thereof to form the ink feed holes 18; a known method may be employed.

Similarly, on the method of etching the Si substrate 12 from the front surface thereof to form the ink groove 16, no particular limitation is placed; a known method may be employed. Therefore, either wet etching or dry etching can be used, and further, it is also possible to perform processing by wet etching at first and then switch it to dry etching midway (or vice versa).

In the recording head 10 of the present invention, processing for the approximate shaping may be performed by sandblast and then processing for the precision finish by wet etching and/or dry etching.

Here, it is to be noted that, in view of the strength and the production yield of the recording head 10, the thicker the Si substrate 12 is, the more favorable it is, but, on the other hand, the processing efficiency thereof lowers. However, in case of the present invention according to which the ink feed holes 18 that require a large amount of processing are formed by sandblast, the fall in the processing efficiency due to thickening the Si substrate 12 is very small. As mentioned above, however, sandblast is a grinding process utilizing impact, so that breaks, etc. are often caused at the edges of the processed portions, and therefore, if the amount of processing by etching is too small, the breaks caused by sandblast remain in the edge portions of the ink groove 16 in some cases.

In view of the above-mentioned matter, in the present invention, it is desirable to set the thickness of the Si substrate 12 to 600 $\mu$m or more and, further, set the depth (the processing depth provided by etching) of the ink groove (the front surface feed path) 16 to at least 20 $\mu$m but not more than 400 $\mu$m. Further, the depth of the ink groove 16 should preferably be set to 300 $\mu$m or less and, more preferably, to 200 $\mu$m or less.

In the recording head 10, an orifice plate 22 in which the nozzles 20 are formed (bored) is laminated on and stuck on the partition wall 15.

As the materials for forming the orifice plate 22 and the partition wall 15, can be used various known materials, for example, polyimide.

Figure 2A:
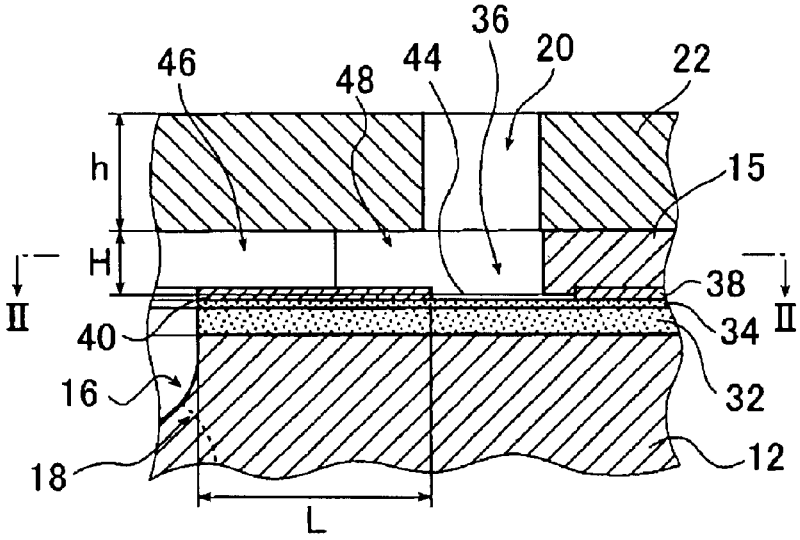
FIG. 2A is a partial enlarged view of FIG. 1B.
Figure 2B:
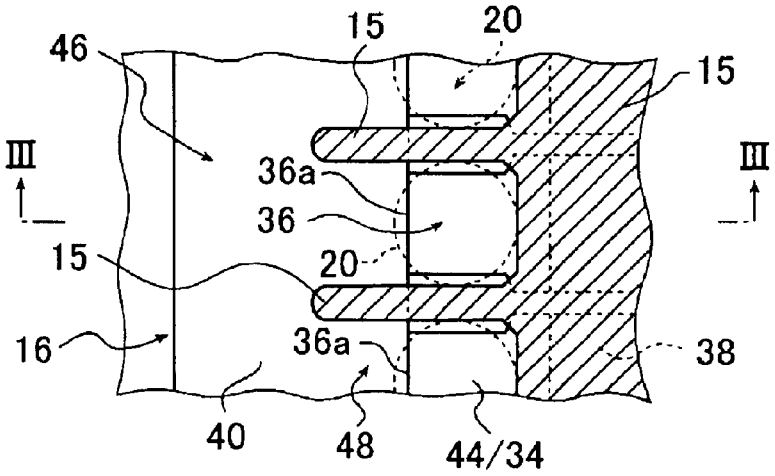
FIG. 2B is a schematic sectional view taken along the line II—II in FIG. 2A.

FIG. 2A is an enlarged view of the nozzle 20 and its vicinity shown in FIG. 1B, and FIG. 2B is a sectional view taken along the line II—II in FIG. 2A. Accordingly, the section along the line I—I in FIG. 1A is the same as the section along the line III—III in FIG. 2B.

As shown in FIGS. 2A and 2B, a silicon dioxide ($SiO_2$) layer 32 is formed on the Si substrate 12 at the same time when the driving integrated circuits 14 are formed by the LSI manufacturing process. This $SiO_2$ layer 32 serves as a heat insulation layer as well as an electrically insulating layer.

On the $SiO_2$ layer 32, a thin film resistor 34 is formed. Further, in the regions on the thin film resistor 34 other than the regions 36*a* (where the heating portions of the heaters are located) corresponding to the nozzles 20, individual conductor thin films 38 corresponding to the respective nozzles 20 are formed on the side where the driving integrated circuits 14 are located with respect to the nozzles 20, and further, on the side opposite to the above side, a common conductor thin film 40 which is common to a plurality of nozzles 20 is formed. The thin film resistor 34, the individual conductor thin films 38 and the common conductor thin film 40 constitute heaters 36 associated with the respective nozzles 20.

Further, in the recording head 10, gold plating layers may be formed covering both the conductor thin films 38 and 40 as required.

In the shown example, the thin film resistor 34 is formed of a ternary alloy consisting of tantalum (Ta)-silicon (Si)-oxygen (O) and the individual conductor thin films 38 and the common conductor thin film 40 are formed of nickel (Ni), for example.

Further, in the regions of the thin film resistor 34 which are not covered with the conductor thin films, that is, the regions 36*a* corresponding to the nozzles 20, electrically insulating coatings 44 are formed by heating and oxidizing the thin film resistor 34 (the above-mentioned ternary alloy) in an oxidizing atmosphere. The thus formed electrically insulating coatings 44 have an excellent strength and corrosion resistance to the ink and function as protective layers.

the recording head according to the present invention is not limited to the above-mentioned structure but, as the thin film resistor, there may alternatively be used a thin film resistor composed of hafnium (Hf)-boron (B) or Ta-aluminum (Al), a conductor thin film composed of Al may be used, and such a thin film resistor as above may have a protective layer intended for providing a resistance to corrosion, a resistance to cavitation or the like.

As shown in FIG. 1 and FIG. 2, the partition wall 15, which defines the individual ink flow paths 48 for guiding the ink from the ink groove 16 to the respective nozzles 20, has a region formed extending as far as the extreme vicinities of the nozzles 20 in a state covering the whole area on the side opposite to the side where the ink groove 16 is located with reference to the nozzles 20 (namely, a front wall portion of the end of the partition wall 15 that is toward the downstream of the individual ink flow paths 48) and has also side wall portions that project from the front wall portion (the region as referred to above) toward the ink groove 16 through the spaces between the respective nozzles 20 reaching somewhat closer to the ink groove 16 than the nozzles 20 (thus separating the adjacent nozzles 20 from each other). In other words, in the shown example, the side wall portions of the partition wall 15 separate the respective nozzles 20 from one another in the direction of the nozzle rows to thereby define the individual ink flow paths 48 for the respective nozzles 20.

Here, it is to be noted that, in the recording head 10 according to the present invention, the following expression (1) is preferably satisfied:

$$5H+h \geqq L \geqq 2H+h \quad (1)$$

[wherein L stands for the distance from the edge of the ink groove 16 (namely, the end portion of the ink groove 16 that is toward the individual flow paths 48) to the heating portion 36*a* of the heater 36 (the end portion of the common conductor thin film 40 in case of the shown example), H stands for the thickness of the partition wall 15 (that is, the distance from the ink-heating surface (the upper surface of the oxide coating 44 in case of the shown example) to the lower end of the nozzle 20), and h stands for the length of the nozzle 20] while H is 6 $\mu$m or less and h is 10 $\mu$m or less.

Figure 2C:
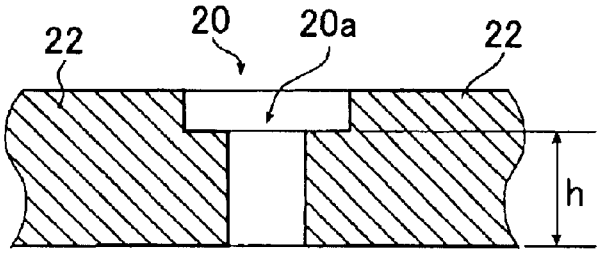
FIG. 2C is a schematic diagram showing another embodiment of the nozzle.

If the nozzle 20 has a stepped shape just like a nozzle 20*a* shown in FIG. 2(C), the length h of the nozzle is defined as the length that substantially effects the ejection of the ink, as shown the figure.

Of late, efforts are made to reduce the ejected amount of ink (the amount of ink droplets) and to enhance the ink ejection frequency for the purpose of improving the image quality and the recording speed. Through the examinations made by the present inventors, it has been found that it is effective to reduce the thickness H of the partition wall 15 and the distance L from the ink groove 16 to the heater in order to realize a desirable reduction of the ink ejection amount to a very small amount such as 2 pL (picoliters) or less and a desirably high ink ejection frequency such as 20 kHz or more.

However, if the distance L is too short, then there is the possibility that the adjacent nozzles 20 may interfere in each other to make the ink ejection amount unstable, to the contrary.

In contrast, by setting the thickness H of the partition wall 15, the distance L, and the length h of the nozzle so as to satisfy the conditions shown by the above-mentioned expression (1), the reduction of the ink ejection amount and the enhancement of the ink ejection frequency can be realized more suitably, and at the same time, the interference of the adjacent nozzles 20 in each other can be prevented, so that a stable ink ejection can be realized.

Further, in case of the present invention according to which the ink groove 16 is formed by etching of Si, a highly accurate formation of the ink groove 16 satisfying the above-mentioned conditions can also be made easily.

As in case of the aforementioned known example, the recording head 10 is bonded/secured (mounted) at a predetermined position in a frame 24 and fitted into a head unit (e.g., a so-called cartridge) or the like of an inkjet printer. Further, in the frame 24, an ink flow path 26 is formed.

In the recording head 10, the ink fed through a predetermined route from an ink tank connected to the head unit is fed via the ink flow path 26 in the frame 24 to the ink feed holes 18 from the back surface side of the Si substrate 12 and introduced into the ink groove 16 formed on the front surface of the Si substrate 12.

The ink fed to the ink groove 16 reaches, through a common ink flow path 46 in which the partition wall 15 is not formed, the individual ink flow paths 48 for the respective nozzles 20, that are separated from one another by the partition wall 15 (the side wall portions thereof) and is ejected from the corresponding nozzles 20 by the nuclear boiling caused by the heating of the heaters 36 driven by any of the driving integrated circuits 14. (The ink is ejected in the direction of the front of the drawing plane in cases with FIGS. 1A and 2B, or upward in the figures in cases with FIGS. 1B and 2A).

Recording heads having a constitution analogous to that of the recording head 10 as described above are described in detail in JP 06-71888 A, JP 06-297714 A, JP 07-227967 A, JP 08-20110 A, JP 08-207291 A, JP 10-16242 A, etc.

The recording head 10 according to the present invention as described above can basically be manufactured in the same manner, except for the formation of the ink groove 16 and the ink feed holes 18, as in case of various (inkjet) recording heads in each of which heaters, etc. are formed on an Si substrate.

A preferred example of the method of manufacturing the recording head 10 in accordance with the present invention will be described below, referring to the flowchart shown in FIG. 3.

First, the driving integrated circuits 14 are formed on the Si substrate 12. Further, through this, the $SiO_2$ layer (silicon dioxide film) 32 serving as an electrically insulating layer and a heat insulation layer is formed as mentioned above.

Figure 4:
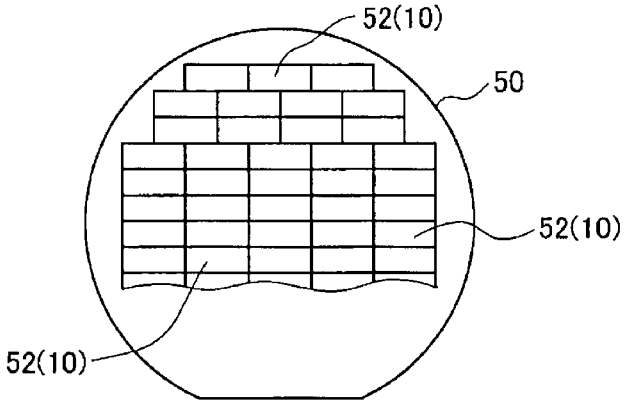
FIG. 4 is a conceptual diagram of the Si wafer for explaining the example of the manufacturing method shown in FIG. 3.

In the present manufacturing method, the steps ranging from the "formation of the driving integrated circuits" to the "water-repelling treatment" are carried out to a semiconductor wafer (hereinafter represented by Si wafer) 50 as shown in FIG. 4, and, in one Si wafer 50, a large number of semiconductor (Si) chips 52 each to be used as the recording head 10 are fabricated and finally they are cut from one another for the individual use as the recording head 10.

After the driving integrated circuits 14 are formed, a ternary alloy film consisting of Ta—Si—O that is to be made the thin film resistor 34, and then an Ni film that is to be made the conductor thin films 38 and 40 are formed, for example, by sputtering; and, by photoetching, the heaters 36 each comprising the thin film resistor 34, the individual conductor thin film 38 and the common conductor thin film 40 are formed. After this, the whole is heated in an oxidizing atmosphere, whereby the surface layer of the ternary alloy is oxidized to form the electrically insulating coatings 44.

After the electrically insulating coatings 44 are thus formed, a material such as polyimide for forming the partition wall 15 is applied by spin coating or the like and formed into the partition wall 15 by photo dry etching. The thickness H of the partition wall 15 can be adjusted through the amount of polyimide applied.

After this, sandblast is performed from the back surface of the Si substrate 12 to form the ink feed holes 18, and then, etching of Si is performed from the front surface to form the ink groove 16.

Figure 5A:
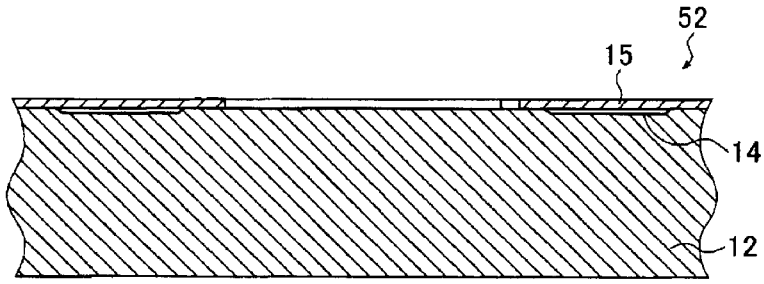
FIGS. 5A, 5B and 5C are schematic diagrams for explaining respective steps of the example of the manufacturing method shown in FIG. 3.
Figure 5B:
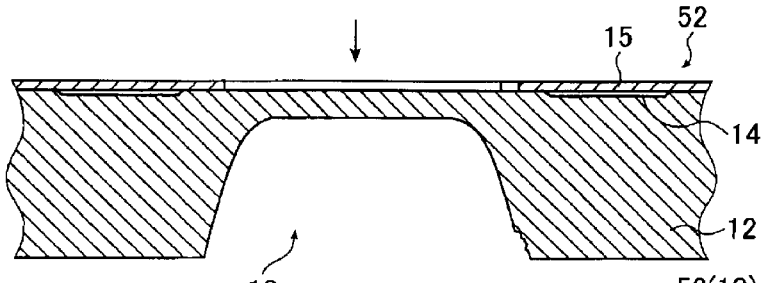
Figure 5C:
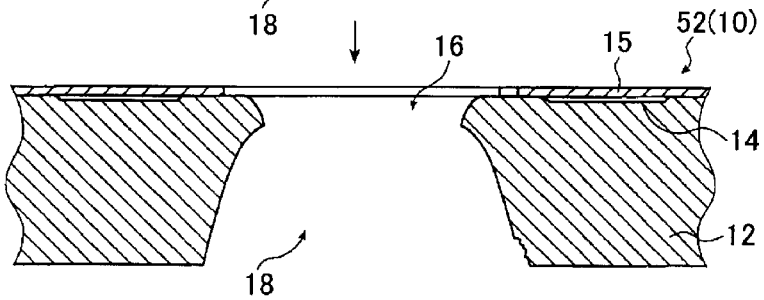

In this case, as shown in FIGS. 5A and 5B, the formation of the ink feed holes 18 by sandblast is not performed as far as the holes pierce the Si substrate 12, but the sandblast is terminated when the holes are bored to a point somewhat short of the electrically insulating layer formed beneath (on the back surface side of) the driving integrated circuits 14, for example, to the point where the thickness of the remaining portion of the Si substrate 12 is about 100 $\mu$m. Subsequently, the ink groove 16 is formed from the front surface by etching, whereby the ink feed holes 18 and the ink groove 16 are made communicate with each other through the Si substrate 12, as shown in FIG. 5C.

By forming the ink feed holes 18 and the ink groove 16 by such a procedure as above, the breakage etc. of the edges of the ink groove 16 can be perfectly prevented and a highly accurate processing can be performed, whereby the recording head 10 of a higher quality can be obtained at a higher production yield.

After the ink feed holes 18 and the ink groove 16 are thus formed, the orifice plate 22, in which the nozzles 20 are not formed yet, is laminated and stuck on the partition wall 15, and then, the nozzles 20 are formed by photo dry etching or the like.

After this, preferably, the water-repelling treatment of the surface of the orifice plate 22 is performed. No limitation is placed on the method of performing the water repelling treatment; the water repelling treatment may be performed by a known method.

After a large number of recording heads 10 are thus completed as the Si chips 52, the Si wafer 50 is subjected to dicing to cut the respective recording heads 10 from one another, and further, the recording heads 10 are individually mounted at predetermined positions in the frames 24, and wiring etc. are made.

Figure 6A:
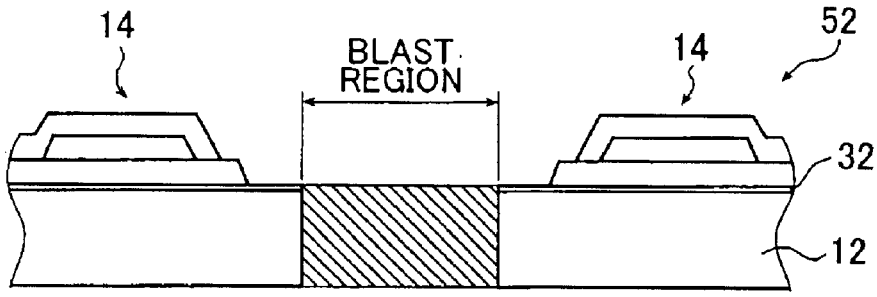
FIGS. 6A, 6B and 6C are each a conceptual diagram for explaining another example of the method for the manufacture of the inkjet recording head according to the present invention.
Figure 6B:
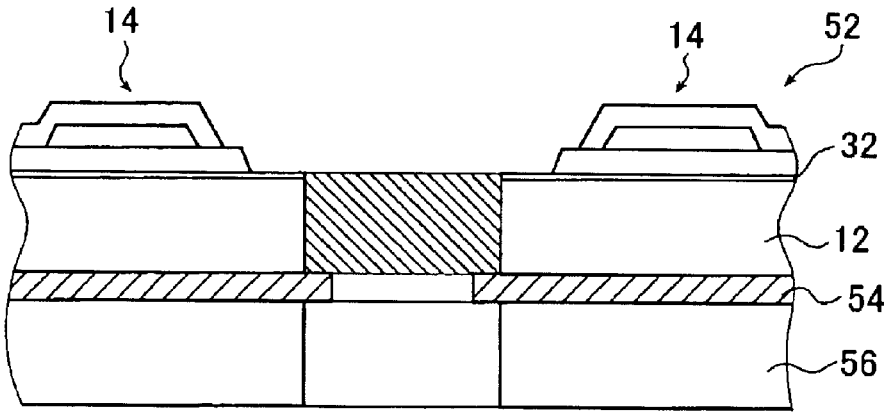
Figure 6C:
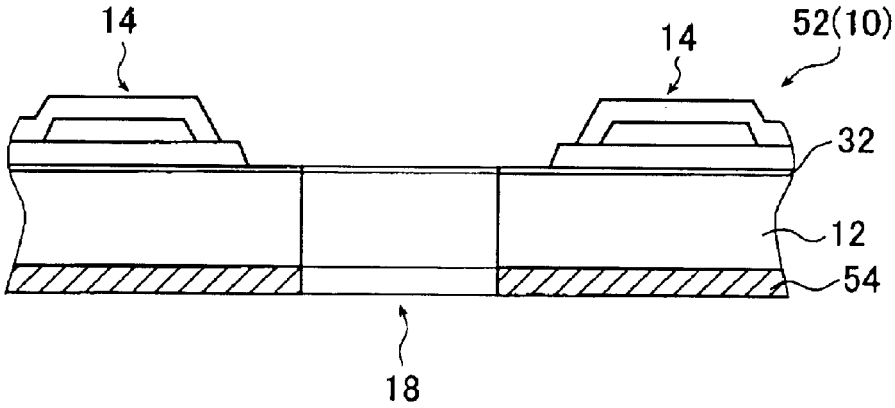

In the case of the embodiment shown in FIGS. 5A to 5C, the formation of the ink feed holes 18 by sandblast from the back surface side of the Si substrate 12 is not performed as far as the holes 18 pierce the Si substrate 12, but the sandblast is terminated when the holes 18 are bored to a point somewhat short of the electrically insulating layer (the $SiO_2$ layer 32) formed beneath (on the back surface side of) the driving integrated circuits 14 and then the ink groove 16 is formed by etching from the front surface side, whereby the ink feed holes 18 and the ink groove 16 are made communicate with each other through the Si substrate 12. The present invention is, however, not limited to this, but the ink feed holes 18 may be formed by sandblast through the Si substrate 12, as shown in FIGS. 6A to 6C. In that case, the ink groove 16 may be formed by etching from the front surface side of the Si substrate 12 after the ink feed holes 18 as pass-through holes are formed by sandblast in the Si substrate 12 from the back surface side.

It is preferred in the formation of the ink feed holes 18 by sandblast from the back surface side of the Si substrate 12 that the holes 18 be formed in the Si substrate 12 in a grounded state after the heaters 36 and the driving integrated circuits 14 for them are formed on the front surface side of the Si substrate 12, as shown in FIGS. 6A to 6C.

FIGS. 6A to 6C are cross sectional concept views showing the steps of another embodiment of the method of manufacturing the recording head of the present invention, respectively.

FIGS. 6A to 6C are schematic cross sectional views showing the steps taken when the ink feed holes 18 are formed through the Si substrate 12 of the recoding head 10 as shown in FIG. 1B by digging blast regions from the back surface side.

FIG. 6A shows a recording head 10 in the form of a semiconductor device after driving integrated circuits 14 are formed on an Si substrate 12. The Si substrate 12 has an $SiO_2$ layer 32 formed on its front surface side and the driving integrated circuits 14 are formed in both the right- and left-hand areas of blast regions which are to be made ink feed holes 18. In FIGS. 6A to 6C, one embodiment of the recording head 10 in the form of a semiconductor (Si) chip 52 is shown in order to facilitate the explanation, although the sandblast process is basically performed to a semiconductor (Si) wafer such as the wafer 50 (shown in FIG. 4) on which a plurality of recording heads 10 are to be fabricated.

Initially, as shown in FIG. 6B, the back surface of the Si substrate 12 is coated with a metal film 54 in the vicinity of circumferential portions of blast regions and then a mask pattern 56 is formed with a photoresist (a masking material) by a photolithography technique.

The metal film 54 is not particularly limited concerning its material. However, it is preferable to use a metal used in a conventional semiconductor manufacturing technology such as Al, W. Ti, Mo, Ta and Pt or an alloy thereof as the material. The metal film 54 may be formed to cover the neighborhood of the circumferential portions of the respective blast regions which are to be made the ink feed holes 18, that is to say, to cover zones of a predetermined range including both the inside and outside of the circumferential portions of the blast regions. It is also possible that the metal film 54 be formed so that it may entirely cover the inside of the circumferential portions of the blast regions.

In each of the Si chips 52 (recording heads 10), the metal film 54 is formed not only so that it may cover the neighborhood of the circumferential portions of the blast regions but also it may extend to the ends of the Si substrate 12 (not shown). With respect to the entire Si wafer 50, the metal film 54 is formed in such a manner that the film 54, which extends in each of the Si chips 52 to be made the recording heads 10 to the ends of the Si substrate 12, is not interrupted by the scribe lines which define the individual chips 52 on the wafer 50.

As described below, the metal film 54 is kept in such a state that it can be electrically connected with the ground, namely in a grounded state, when the ink feed holes 18 are formed by digging through the blast regions of the Si substrate 12 by the sandblast process. For example, the metal film 54 may be connected with the ground line (be grounded) in the respective Si chips 52 (recording heads 10) or, alternatively, it may be connected with a bonding pad or the like for grounding which has been separately formed on the Si wafer 50 as that common to all the chips 52.

The mask pattern 56 is formed to entirely cover the regions of the Si substrate 12 other than the blast regions which are to be dug through by the sandblast process. In order to improve the adhesion between the metal film 54 and the mask pattern 56, the metal film 54 may be coated with a thin protective film of 0.1 $\mu$m or less in thickness. When the sandblast process is performed, such a film as having a thickness of 0.1 $\mu$m or less is instantly scraped off to bare the surface of the metal film 54 before the electrification is effected to a large extent. Consequently, the metal film 54 has the same effect regardless of the presence or absence of the protective film.

Next, the metal film 54 formed on the Si wafer 50 is electrically connected with the ground (namely, grounded) at least partially by, for example, bringing it into contact with the support base for the Si wafer 50 and then the ink feed holes 18 extending through the Si substrate 12 are formed by digging through the blast regions of the Si substrate 12 by sandblast form the front surface side, as shown in FIG. 6C. It is preferable that the resistance arising between the metal film 54 formed on the respective Si chips 52 (recording heads 10) and the ground is as low as possible, specifically 50 MΩ or lower.

Thus, the electric charge produced during sandblast can be led to the ground through the metal film 54 formed on the Si wafer 50 and grounded. As a consequence, recesses (including those of pass-through type) can be formed in the respective Si chips 52 formed on the Si wafer 50 without electrostatic breakdown of the driving integrated circuits 14 of the recording heads 10. In addition, even if the electrification occurs on the regions masked by the mask pattern 56, hardly any problems are caused, since the thickness of the photoresist film is large.

During sandblast, the metal film 54 which is formed extending to the inside of the circumferential portions of the blast regions is scraped off together with the blast regions and as a result reaches such a state as shown in FIG. 6C. FIG. 6C shows the state of the metal film 54 after the mask pattern 56 formed with a photoresist is removed. As seen from the figure, immediately after the formation of the ink feed holes 18 and the removal of the mask pattern 56, the metal film 54 exists on the Si substrate 12 only on the outside of the circumferential portions of the ink feed holes 18 and the end surfaces of the metal film 54 that are located at the circumferential portions of the ink feed holes 18 remain bared.

After the ink feed holes 18 are formed and then the mask pattern 56 is removed, the metal film 54 formed on the Si substrate 12 may be removed partially or entirely or, alternatively, the semiconductor manufacturing process may be continued while leaving the whole metal film 54 as such.

Naturally, the method of manufacturing the printing head 10, in which the metal film 54 is formed and electrically connected with the ground, whereby the sandblast is performed on the Si substrate 12 in a grounded state, is applicable not only to the case where the ink feed holes 18 are to be formed as pass-through holes as shown in FIGS. 6A to 6C but also to the case where the holes 18 are to be bored to a point somewhat short of the $SiO_2$ layer 32, that is to say, the holes 18 should not be formed through the Si substrate 12 as shown in FIGS. 5A to 5C.

In the embodiment as described above, the ink is fed from the ink feed holes 18 formed on the back surface side of the Si substrate 12 to the ink groove 16 formed on the front surface side of the Si substrate 12 (in the direction perpendicular to the Si substrate 12, from the back surface of the substrate 12 to the front surface thereof upward, in the example shown), further fed from the ink groove 16 to the heaters 36 through the individual ink flow paths 48 extending in the lateral direction (fed in the direction parallel to the Si substrate 12 in the example shown), and then ejected from the nozzles 20 by the heating of the heaters 36 (in the direction perpendicular to the Si substrate 12 in the example shown). The present invention is, however, not limited to this, but such a constitution as shown in FIGS. 7A and 7B comprising no ink flow path extending in the lateral direction may also be possible.

Figure 7A:
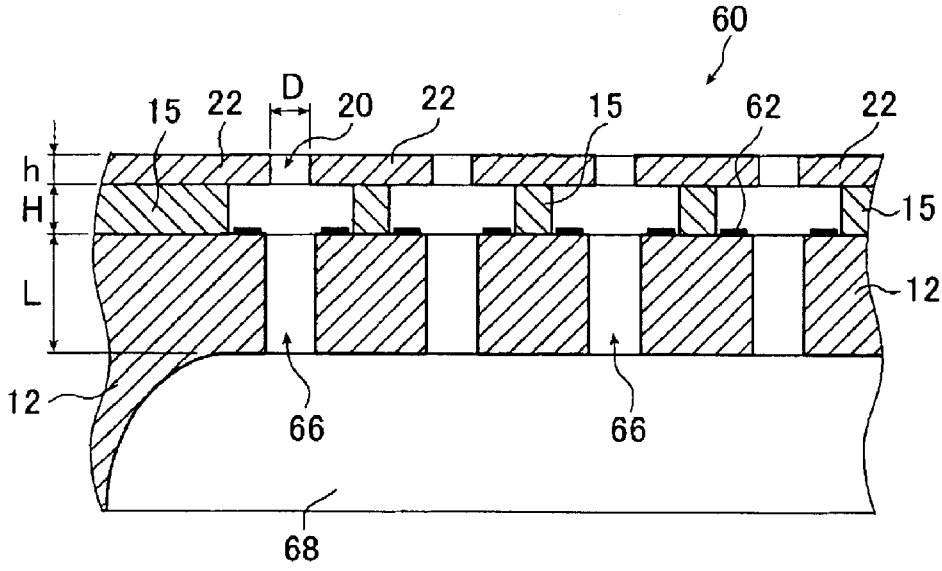
Figure 7B:
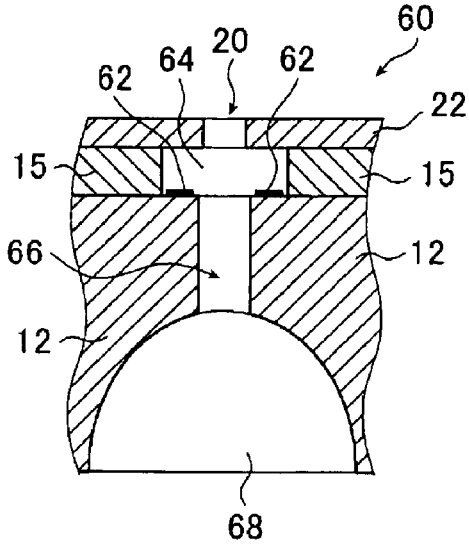

FIGS. 7A and 7B show another embodiment of the inkjet recording head according to the present invention. FIG. 7A is a schematic sectional view taken along the direction of nozzle arrangement and FIG. 7B is a schematic sectional view taken along the direction orthogonal to the nozzle arrangement direction.

A recording head 60 sown in FIGS. 7A and 7B has the same constitution as the recording head 10 shown in FIGS. 1A and 1B except that the flow paths for ink are linear in the head 60. Accordingly, the same elements as those shown in FIGS. 1A and 1B will be referenced by the same reference numerals, and the detailed description thereof is omitted.

As shown in FIGS. 7A and 7B, in the recording head 60, annular heaters 62, driving integrated circuits for the heaters 62 (not shown), etc. are formed on the front surface side of the Si substrate 12 and on such elements further laminated a partition wall 15 defining individual ink feed paths 64 for respective nozzles 20 (heaters).

In the Si substrate 12 are formed a plurality of first ink feed paths 66 corresponding to the individual ink flow paths 64 for the respective nozzles 20 for feeding ink to the individual ink flow paths 64 individually, and a second ink feed path 68, which is common to all the first ink feed paths 66 each corresponding to one of a plurality of nozzles 20 and feeds ink to all the first ink feed paths 66. The individual ink flow paths 64 and the first ink feed paths 66 are individual ink flow paths each provided correspondingly to one of a plurality of nozzles 20, while the second ink feed path 68 is a common ink flow path which is common to all the nozzles 20. In this embodiment, the nozzles 20, the individual ink flow paths 64 and the first ink feed paths 66 are formed as linear ink flow paths.

In the present embodiment also, on the front surface side of the Si substrate 12 are formed the heaters 62 (with respect to them, the thin film resistor 34 as well as the conductor thin films 38 and 40 in FIG. 2A are to be referred to) in a circular form and the driving integrated circuits for the heaters 62 as well (not shown) and on these elements further laminated the partition wall 15, then the second ink feed path 68 as a common ink flow path is firstly formed by the sandblast process from the back surface side of the Si substrate 12. Secondly, the first ink feed paths 66 in a cylindrical form are formed by the etching process from the front surface side of the Si substrate 12, each path 66 provided in the center of one of the annular heaters 62, as pass-through holes communicating with the second ink feed path 68. As a result of such a processing, the heaters 62 are rendered annular.

Subsequently, an orifice plate 22 in which a plurality of nozzles 20 are to be bored is laminated and stuck on the partition wall 15 provided on the Si substrate 12. Then, a plurality of nozzles 20 (of which only four are shown) are bored in the orifice plate 22.

In this way, the recording head 60 as the present embodiment is manufactured.

In the present embodiment also, the following expression (1) is preferably satisfied:

$$5H+h \geqq L \geqq 2H+h \quad (1)$$

[wherein H stands for the height of the partition wall 15 that corresponds to the length of the individual ink flow path 64, h stands for the length of the nozzle 20 that is equal to the thickness of the orifice plate 22, and L stands for the length of the first ink feed path 66] while H is 6 μm or less and h is 10 μm or less, as is the case with the aforementioned embodiment.

The individual ink flow paths 64 of the present embodiment are comparable to the individual ink flow paths 48 of the aforementioned embodiment shown in FIGS. 1 and 2 in view of the fact that they include the heaters 62 and they are defined by the partition wall 15. The first ink feed paths 66 may be regarded as the front surface feed paths Of the present invention in view of the fact that they are provided on the front surface side of the Si substrate 12 and they feed ink to the individual ink flow paths 64, although formed as individual ink flow paths, and the ink feed paths 66 have such a function also as that of the ink groove 16 of the aforementioned embodiment. Again, the second ink feed path 68 can be regarded as the back surface feed path of the present invention and is comparable to the ink feed holes 18 of the aforementioned embodiment in view of the fact that it is provided on the back surface side of the Si substrate 12 and it feeds ink to the first ink feed paths 66.

As described above, in the recording head 60 of the present embodiment, the second ink feed path 68 is formed by sandblast from the back surface of the Si substrate 12 and the first ink feed paths 66 are formed by etching of Si from the front surface of the Si substrate. Therefore, in the recording head 60 also, the second ink feed path 68, which requires a large amount of processing while requiring not so high a processing accuracy, can be formed securing a good processing efficiency, and the first ink feed paths 66, which require a high processing accuracy while requiring only a small amount of processing, can be formed free from the break or other damage of the edges thereof and with a sufficiently high accuracy, as is the case with the aforementioned embodiment.

As a consequence, it is possible in the present embodiment just like in the aforementioned embodiment to improve the quality of images recorded since the first ink feed paths 66 free from the break or other damage of the edges thereof and, moreover, having good surface property and state can realize a good uniformity in flow of the ink to the respective nozzles 20 (individual ink flow paths 64). Further, since the first ink feed paths 66 can be formed with at high accuracy, the ink may be ejected in an extremely small amount and at an enhanced frequency.

In addition, sandblast is performed from the back surface side of the Si substrate 12 preferably in a grounded state, so that the front surface of the Si substrate 12 is not charged with static electricity during sandblasting, and thus, the static breakdown of the driving integrated circuits 14 formed on the front surface side of the Si substrate 12 can be prevented.

That is to say, the recording head 60 of the present embodiment is also a recording head that has such excellent characteristics that it can perform a high-speed image recording with a high accuracy and a high image quality, and in addition, the processibility (i.e., productivity) and production yield thereof are both good.

Figure 8A:
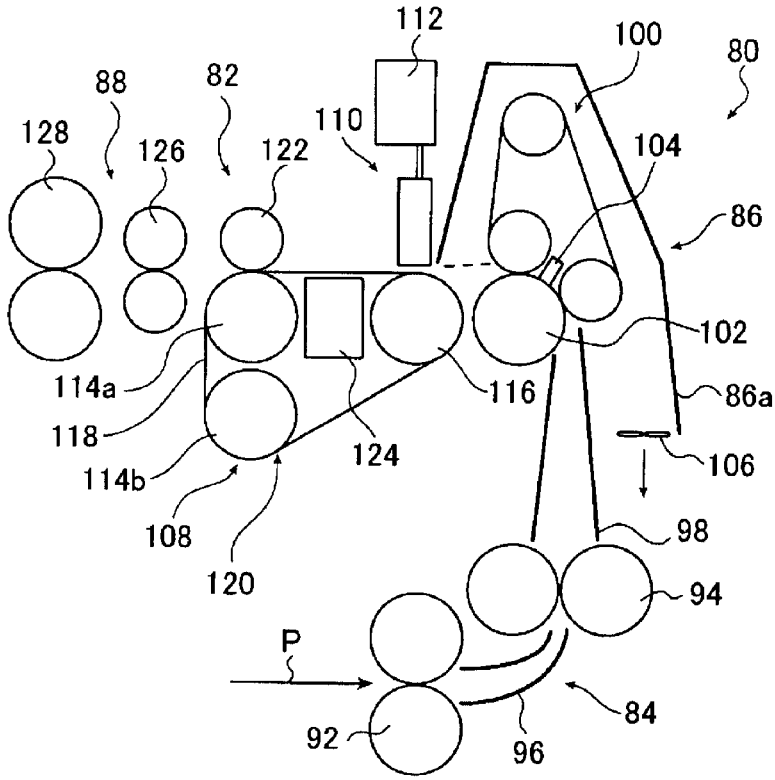
FIGS. 8A and 8B are each a conceptual diagram of an embodiment of the inkjet printer according to the present invention.
Figure 8B:
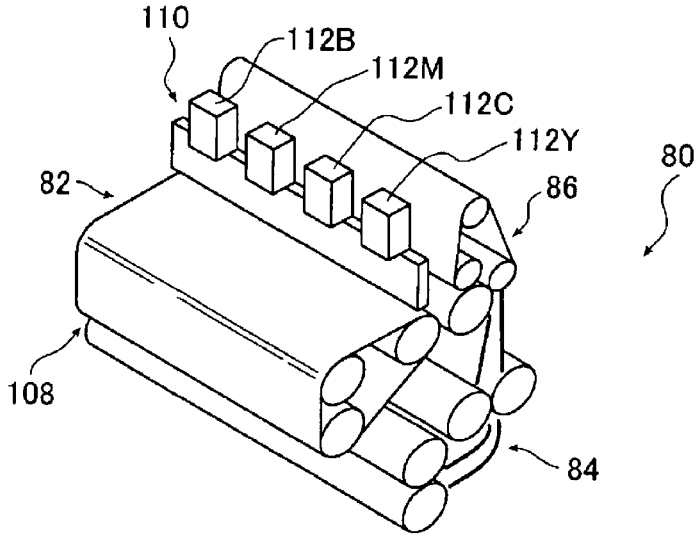

FIGS. 8A and 8B are schematic diagrams showing an embodiment of the inkjet printer of the present invention, in which the recording head 10 according to the present invention as described before is used. FIG. 8A is a conceptual view showing the constitution of this inkjet printer, and FIG. 8B is a conceptual view showing this inkjet printer as seen from an oblique direction.

The inkjet printer 80 (hereinafter referred to as the printer 80) shown in FIGS. 8A and 8B is, basically, a known inkjet printer except for the use of the recording head 10 according to the present invention; and, as the recording head 10, there is used a so-called line head that has nozzle rows extending beyond the length of one side of recording paper P.

The printer 80 shown in FIGS. 8A and 8B comprises a recording portion 82 using the recording head 10 according to the present invention, a paper feed portion 84, a pre-heating portion 86, and a discharge portion 88 (not shown in FIG. 8B). The printer 80 may further include a maintenance unit that has a wiper, a cap, etc. for cleaning and protecting the recording head 10.

The paper feed portion 84 comprises conveyance roller pairs 62 and 94 and guides 96 and 98, and the recording paper P is conveyed upwards from the horizontal direction by the paper feed portion 84 and fed to the pre-heating portion 86.

The pre-heating portion 86 is comprised of a conveyor 100 consisting of three rollers and an endless belt, a pressure roller 102 pressed against the endless belt from outside the conveyor 100, a heater 104 pressed against the pressure roller 102 (the endless belt) from inside the conveyor 100, and an exhaust fan 106 for exhausting the air in the pre-heating portion 86 (in a housing 86*a*).

The pre-heating portion 86 of such a structure is for heating the recording paper P prior to the image recording by the inkjet to thereby accelerate the drying of the ink; and thus, the recording paper P conveyed from the paper feed portion 84 is heated by the heater 104 while it is being conveyed in a state sandwiched between the conveyor 100 and the pressure roller 102 and conveyed to the recording portion 82.

The recording portion 82 is comprised of a head unit 110 using the recording head 10 according to the present invention and a recording/conveying unit 108.

In the head unit 110, the recording head 10 according to the present invention is mounted, and the head unit 110 is comprised of ink tanks 112 (112Y, 112C, 112M and 112B). The recording/conveying unit 108 is comprised of a conveyor 120 consisting of rollers 114*a* and 114*b*, a suction roller 116 and a perforated endless belt 118, a nip roller 122 (not shown in FIG. 8B) pressed against the perforated endless belt 118, and a suction box 124 disposed inside the conveyor 120.

The recording head 10 is disposed in the state in which the nozzles 20 are directed toward the suction roller 116. Further, the recording/conveying unit 108 continuously conveys the recording paper P at a predetermined speed in the direction perpendicular to the direction of the nozzle rows in the recording head 10. Accordingly, the recording paper P fed from the pre-heating portion 86 has its whole surface scanned by the nozzle rows in the recording head 10 that is a line head, and thus, the image is recorded.

Further, during the recording, the suction roller 116 and the suction box 124 are driven, so that the recording paper P is conveyed in a state sucked to the perforated endless belt 118 and conveyed in a state kept at a predetermined position with respect to the recording head 10.

The recording paper P with the image thus recorded thereon is fed to the discharge portion 88, conveyed by a conveyance roller pair 126 and a discharge roller pair 128 and discharged into, e.g., a discharge tray (not shown).

Further, the inkjet printer according to the present invention is not limited to the above-described example, but various types of known inkjet printers can also be utilized; for example, a serial type printer that intermittently conveys the above-mentioned recording paper and, at the same time, scans the paper with the recording head (head unit) using a carriage may also be used, and further, the inkjet printer may include a feeder or the like that automatically feeds the recording paper.

In the above, the liquid ejection apparatus according to the present invention, the method of manufacturing the liquid ejection apparatus according to the present invention, the inkjet printer according to the present invention, and the method of manufacturing the inkjet printer according to the present invention have been described in detail, but the present invention is not limited to the above-described embodiments; it is a matter of course that various improvements or modifications may be made without departure from the spirit of the present invention.

EXAMPLES

The present invention will now be described in more detail, referring to concrete examples of the present invention.

Example 1

Figure 3:
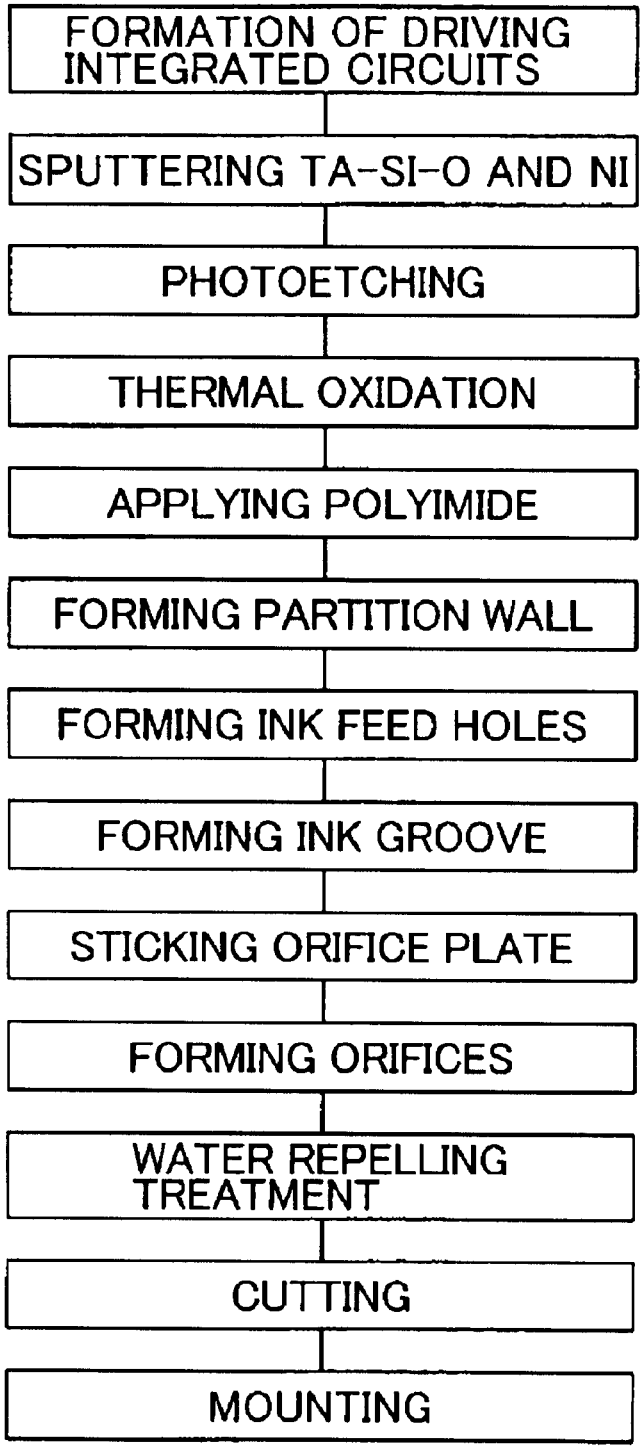
FIG. 3 is a flowchart explaining an example of the method for the manufacture of the inkjet recording head shown in FIG. 1.

In accordance with the flowchart shown in FIG. 3, the recording heads 10 as shown in FIG. 1 and FIG. 2 were fabricated.

First, by utilizing the semiconductor device manufacturing technology, the driving integrated circuits 14 associated with the respective recording heads 10 were formed on an Si wafer with a thickness of 600 μm. Through this, moreover, the $SiO_2$ layer 32 was formed on the upper surface of the Si substrate 12.

Subsequently, by sputtering, a film of a ternary alloy comprised of Ta—Si—O was formed; further, an Ni film was formed; and, by photoetching, the ink ejecting heaters 36 comprising the thin film resistor 34, the individual conductor thin films 38 and the common conductor thin film 40 were formed.

After this, by heating the whole in an oxidizing atmosphere, the ternary alloy was oxidized to form the electrically insulating coatings 44.

After the formation of the electrically insulating coatings 44, polyimide was applied by spin coating or the like, and, by photo dry etching, the partition wall 15 was formed.

Next, on both surfaces of the Si substrate 12 (in the form of Si wafer), a mask comprised of a photoresist was formed by photolithography; the ink feed holes 18 were formed from the back surface by sandblast; and, after this, by wet-etching of Si from the front surface, the ink grooves 16 were formed. In such formations, as mentioned above, the sandblasting was stopped before the holes 18 pierce the Si substrate 12, that is, at the time the thickness of the remaining portion of the Si substrate 12 (Si wafer) was about 100 μm (in other words, the processing depth was about 500 μm). After this, the ink feed holes 18 and the ink grooves 16 were made to communicate with each other by wet etching.

Thereafter, a bonding agent was applied onto one surface of the orifice plate 22; the orifice plate 22 was laminated and stuck on the front surface of Si wafer; and further, by photo dry etching, the nozzles 20 were formed corresponding to the respective recording heads 10.

After the nozzles 20 were formed, the Si wafer was subjected to dicing to cut the respective recording heads 10 from one another.

Seven kinds of such recording heads as the recording heads 10 fabricated as above (heads 1 to 7) were fabricated by varying the thickness H of the partition wall 15, the length h of the nozzle, the distance L from the ink groove 16 to the heaters, and the diameter D of the nozzle.

The dimensions of the respective recording heads are shown in Table 1. In Table 1, the unit of the respective sizes is μm.

The respective recording heads were confirmed, by the use of the following methods, with respect to the responsibility in ink feed and the non-interference between the adjacent nozzles 20.

[Responsibility in Ink Feed]

To the ink ejecting heaters, a pulse voltage with a pulse width of 3 μsec was applied at frequencies of 20 kHz and 30 kHz, and at the same time, the recording paper was conveyed at a fixed speed (in the direction perpendicular to the nozzle rows), whereby independent dots were recorded in straight lines. Further, in this test, in order to eliminate the influences of the interference of the adjacent nozzles in each other, the recording was performed by ejecting the ink from five nozzles which are located every ten nozzles.

The diameters of the recorded dots were calculated, and, in case the deviation of the diameter of any dot from the average value was 10% or less, it was decided that the responsibility was good, as symbolized by "○", while in case there existed one or more dots having a diameter whose deviation from the average value exceeded 10%, it was decided that the responsibility was not good, as symbolized by "X". The results are also shown in Table 1.

[Non-Interference Between the Adjacent Nozzles]

Independent dots were recorded in a straight line in such a manner that, to three adjacent ink ejecting heaters, a pulse voltage with a pulse width of 3 μsec was applied with a phase shift per 3 μsec and at a frequency of 10 kHz, and at the same time, the recording paper was conveyed at a fixed speed (in the direction perpendicular to the nozzle row direction).

The diameters of the recorded dots were calculated, and, in case the deviation of the diameter of any dot from the average value was 10% or less, it was decided that the responsibility was good, as symbolized by "○", while in case there existed one or more dots having a diameter whose deviation from the average value exceeded 10%, it was decided that the responsibility was not good, as symbolized by "X".

The reason why the ejection frequency was set to 10 kHz is that the evaluation was to be made under the condition that the responsibility of ink feed need not be taken into consideration.

The results are also shown in Table 1.

TABLE 1

| | H | h | L | D | 5H + h | 2H + h | Responsibility 20 kHz | Responsibility 30 kHz | Non-interference | Synthetic evaluation |
|---|---|---|---|---|---|---|---|---|---|---|
| Head 1 | 6 | 10 | 40 | 12 | 40 | 22 | ○ | ○ | ○ | ◎ |
| Head 2 | 4 | 8 | 16 | 10 | 28 | 16 | ○ | ○ | ○ | ◎ |
| Head 3 | 5 | 10 | 28 | 16 | 35 | 20 | ○ | ○ | ○ | ◎ |
| Head 4 | 6 | 10 | 50 | 12 | 40 | 22 | X | X | ○ | Δ |
| Head 5 | 4 | 8 | 12 | 10 | 28 | 16 | ○ | ○ | X | Δ |

TABLE 1-continued

| | H | h | L | D | 5H + h | 2H + h | Responsibility 20 kHz | 30 kHz | Non-interference | Synthetic evaluation |
|---|---|---|---|---|---|---|---|---|---|---|
| Head 6 | 8 | 10 | 40 | 12 | 50 | 26 | ○ | X | ○ | ○ |
| Head 7 | 6 | 12 | 40 | 12 | 42 | 24 | ○ | X | ○ | ○ |

With respect to the results of all the tests, the heads 1 to 7 were synthetically evaluated as follows: the head, which had a good result in all the two kinds of the responsibility tests (at 20 kHz and 30 kHz) and the non-interference test, was evaluated as very good, as symbolized by "◎"; the head, which had a good result in one responsibility test and the non-interference test as well, was evaluated as good, as symbolized by "○"; the head, which had a good result in the non-interference test but had not in the two responsibility tests, and the head, which had a good result in the two responsibility tests but had not in the non-interference test, were evaluated as not so good, as symbolized by "Δ"; and the head, which had a good result in none of the three tests, namely the two responsibility tests and the non-interference test, was evaluated as not good, as symbolized by "X".

According to the results shown above, the head 4, which has L larger than 5H+h and thus does not satisfy the expression (1) as referred to before, has been decided as "X" in respect of both the two tests about the responsibility in ink feed, even though it has been decided as "○" in respect of the test about the non-interference between the adjacent nozzles, while the head 5, which has L smaller than 2H+h and thus does not satisfy the expression (1) as referred to before, has been decided as "X" in respect of the test about the non-interference between the adjacent nozzles, even though it has been decided as "○" in respect of the tests about the responsibility in ink feed.

If the ejection frequency is of an ordinary value such as about 10 kHz, however, the responsibility of the head 4 will be good enough; there is no problem. On the other hand, according to the present invention, a recording head such as the head 5 having L of 12 μm can be indeed fabricated with a high accuracy. However, it is difficult with the recording head having such dimensions as of the head 5 to perfectly avoid the interference between the adjacent nozzles, even if the processing accuracy is fairly high. Although, such a recording head as above can be used in the case of recording alphabets with a high speed and with a relatively low quality (as in the draft mode), of printing Chinese characters of a larger size, and so on.

The head 6 having H larger than 6 μm and the head 7 having h larger than 10 μm have been both decided as "X" in respect of the test about the responsibility in ink feed at 30 kHz, but both decided as "○" in respect of either of other two tests. Accordingly, they can be used without problem as an inkjet recording head operating at an ordinary ejection frequency.

Comparative Example 1

Conventional recording heads were fabricated in exactly the same manner as in case of Example 1 except that the ink feed holes 154 were formed from the back surface of the Si substrate 12 (in the form of Si wafer) by wet etching of Si and not by sandblast.

As a result, in case of any of the seven kinds of recording heads, it took time about five times as long as that in case of Example 1 to form the ink feed holes 154.

Further, exactly identical comparative experiments were conducted by using an Si wafer with a thickness of 825 μm and setting the processing depth of the ink feed holes 154 to 625 μm, and by using an Si wafer with a thickness of 925 μm and setting the processing depth of the ink feed holes 154 to 825 μm.

As a result, in case of any of the conventional recording heads fabricated as stated above, in which the ink feed holes 154 were formed by wet etching, the time spent for forming the ink feed holes 154 was more than five times as much as the time spent in case of the present invention in which the ink feed holes 18 were formed by sandblast.

Further, comparative experiments exactly identical to the Comparative Example 1 were conducted by the use of dry etching of Si in place of wet etching of Si.

As a result, in case of any of the conventional recording heads obtained, in which the ink feed holes 154 were formed by dry etching, the time spent for the formation of the ink feed holes 154 was similarly more than five times as much as the time spent in case of the present invention in which the ink feed holes 18 were formed by sandblast.

Comparative Example 2

Conventional recording heads were fabricated in exactly the same manner as in case of Example 1 except that the ink grooves 152 were formed from the front surface of the Si substrate 12 (in the form of Si wafer) by sandblast and not by wet etching of Si.

As a result, in case of any of the seven kinds of recording heads, the ink groove 152 formed had a finished dimension of lower accuracy and the variation in the dimension accuracy thereof was about 20 times greater than that in Example 1. With respect to the seven kinds of recording heads obtained, the responsibility in ink feed and the non-interference between the adjacent nozzles were confirmed following the procedures as described in Example 1 and, as a result of the tests, any of the seven kinds of recording heads was decided as "X" in respect of all three tests about the responsibility in ink feed and the non-interference between the adjacent nozzles and synthetically evaluated as "X", accordingly.

As seen from the above, in the seven kinds of recording heads according to the present invention fabricated in Example 1, a responsibility in ink feed and a non-interference between the adjacent nozzles of a practicable level as well as the high processing accuracy were achieved concurrently with the remarkable saving of the processing costs and time. In particular, the heads 1 to 3 as an example of the recording head according to the present invention have been proved as more excellent in the responsibility in ink feed and the non-interference between the adjacent nozzles.

The present inventors fabricated the seven kinds of recording heads as an example and confirmed the responsibility in ink feed and the non-interference between the adjacent nozzles thereof in a manner identical to that in Example 1 and Comparative Examples 1 and 2 also with respect to the embodiment shown in FIGS. 7A and 7B. In the tests, results similar to those in Example 1 were obtained.

Thus, according to the present invention, both the processing costs and the production efficiency can be greatly improved while keeping the processing accuracy high.

As has been described above in detail, according to the present invention, it is possible to realize a liquid ejection apparatus that is excellent in productivity and production yield and, in addition, high in accuracy; and thus, by utilizing this liquid ejection apparatus in, e.g., an inkjet recording head, images with a high quality can be recorded at high speed. Further, the inkjet printer according to the present invention is an inkjet printer that uses this liquid ejection apparatus and thus has excellent characteristics.

What is claimed is:

1. A liquid ejection apparatus comprising:

a substrate having one side and another side;

a plurality of nozzles formed in a member provided on said one side of said substrate;

a plurality of droplet ejection units, each corresponding to one of said plurality of nozzles, said plurality of droplet ejection units being formed on a surface of said one side of the substrate;

a plurality of individual flow paths, each feeding liquid to one of said plurality of nozzles, said plurality of individual flow paths being formed on said one side of the substrate;

one or more front surface feed paths for feeding liquid correspondingly to said plurality of individual flow paths, said one or more front surface feed paths being formed by etching process from the surface of said one side of the substrate; and one or more back surface feed paths communicating with said one or more front surface feed paths, said one or more back surface feed paths being formed by sandblast process from a surface of said another side or the substrate, wherein:

said plurality of individual flow paths are defined by a plurality of partition walls separating said plurality of nozzles from one another, said plurality of partition walls being formed on said one side of the substrate; and said plurality of nozzles are each bored in a member laminated on said plurality of partition walls and an expression:

$$5H+h \geqq L \geqq 2H+h$$

is satisfied while H is 6 $\mu$m or less and h is 10 $\mu$m or less, wherein H stands for a height of each of said plurality of partition walls, h stands for a length of each of said plurality of nozzles, and L stands for a distance from an end portion of said one or more front surface feed paths that is toward each of said plurality of individual flow paths to each of said plurality of droplet ejection units.

2. The liquid ejection apparatus according to claim 1, wherein the liquid is ejected in a direction approximately perpendicular to a surface of said substrate.

3. A liquid ejection apparatus comprising:

a substrate having one side and another side;

a plurality of nozzles formed in a member provided on said one side of said substrate;

a plurality of droplet ejection units, each corresponding to one of said plurality of nozzles, said plurality of droplet ejection units being formed on a surface of said one side of the substrate;

a plurality of individual flow paths, each feeding liquid to one of said plurality of nozzles, said plurality of individual flow paths being formed on said one side of the substrate;

one or more front surface feed paths for feeding liquid correspondingly to said plurality of individual flow paths, said one or more front surface feed paths being formed by etching process from the surface of said one side of the substrate; and one or more back surface feed paths communicating with said one or more front surface feed paths, said one or more back surface feed paths being formed by sandblast process from a surface of said another side of the substrate, wherein a thickness of said substrate is 600 $\mu$m or more and a depth of each of said one or more front surface feed paths is 20 $\mu$m to 400 $\mu$m.

4. A liquid ejection apparatus comprising:

a substrate having one side and another side;

a plurality of nozzles formed in a member provided on said one side of said substrate;

one or more liquid feed paths comprising one or more second feed paths formed by sandblast process from a surface of said another side of said substrate opposite to said one side on which said plurality of nozzles are located, and one or more first feed paths formed by etching process from the surface of said one side of said substrate on which said plurality of nozzles are located;

a plurality of droplet ejection units, each corresponding to each of said plurality of nozzles, said plurality of droplet ejection units being formed on the surface of said one side of said substrate on which said plurality of nozzles are located; and a plurality of liquid flow paths for feeding liquid to each of said plurality of nozzles, said plurality of liquid flow paths being defined by one or more partition walls separating said plurality of nozzles from one another, wherein:

said plurality of nozzles are bored in a member laminated on said one or more partition walls;

said one or more liquid feed paths comprise one or more first feed paths formed by said etching process in said substrate and one or more second feed paths formed by said sandblast process in said substrate; and an expression:

$$5H+h \geqq L \geqq 2H+h$$

is satisfied while H is 6 $\mu$m or less and h is 10 $\mu$m or less, wherein H stands for a height of said one or more partition walls, h stands for a length of said plurality of nozzles, and L stands for a length of said one or more first feed paths.

5. A method of manufacturing a liquid ejection apparatus which comprises:

a substrate having one side and another side;

a plurality of nozzles formed in a member provided on said one side of said substrate;

a plurality of droplet ejection units, each corresponding to one of said plurality of nozzles, said plurality of droplet ejection units being formed on a surface of said one side of the substrate;

a plurality of individual flow paths for feeding liquid to one of said plurality of nozzles, said plurality of individual flow paths being formed on said one side of the substrate;

one or more front surface feed paths for feeding liquid to said one or more front surface feed paths, wherein:

said plurality of individual flow paths are defined by a plurality of partition walls separating said plurality of nozzles from one another, said plurality of partition walls being formed on said one side of the substrate;

said plurality of nozzles are each bored in a member laminated on said plurality of partition walls; and an expression:

$$5H+h \geqq L \geqq 2H+h$$

is satisfied while H is 6 μm or less and h is 10 μm or less wherein H stands for a height of each of said plurality of partition walls, h stands for a length of each of said plurality of nozzles, and L stands for a distance from an end portion of said one or more front surface feed paths that is toward each of said plurality of individual flow paths to each of said plurality of ink droplet ejection units, said method comprising:

forming said one or more back surface feed paths by sandblast process from a surface of said another side of the substrate; and forming said one or more front surface feed paths by etching process from the surface of said one side of the substrate, thereby making said one or more back surface feed paths and said one or more front surface feed paths communicate with each other through said substrate.

6. The method of manufacturing the liquid ejection apparatus according to claim 5, wherein said one or more front surface feed paths are formed by said etching process after said one or more back surface feed paths are formed by said sandblast process.

7. The method of manufacturing the liquid ejection apparatus according to claim 5, wherein said one or more back surface feed paths are formed in said substrate, which is in a grounded state, after said plurality of droplet ejection units and driving devices for driving the plurality of droplet ejection units are formed on said substrate.

8. An inkjet printer comprising an ink ejection apparatus which includes:

a substrate having one side and another side;

a plurality of nozzles formed in a member provided on said one side of said substrate;

a plurality of ink droplet ejection units, each corresponding to one of said plurality of nozzles, said plurality of ink droplet ejection units being formed on a surface of said one side of the substrate;

a plurality of individual flow paths, each feeding ink to one of said plurality of nozzles, said plurality of individual flow paths being formed on said one side of the substrate;

one or more front surface feed paths for feeding ink correspondingly to said plurality of individual flow paths, said one or more front surface feed paths being formed by etching process from the surface of said one side of the substrate; and one or more back surface feed paths communicating with said one or more front surface feed paths, said one or mote back surface feed paths being, formed by sandblast process from a surface of said another side of the substrate, wherein:

said plurality of individual flow paths are defined by a plurality of partition walls separating said plurality of nozzles from one another, said plurality of partition walls being formed on said one side of the substrate;

said plurality of nozzles are each bored in a member laminated on said plurality of partition walls; and an expression:

$$5H+h \geqq L \geqq 2H+h$$

is satisfied while H is 6 μm or less and h is 10 μm or less wherein H stands for a height of each of said plurality of partition walls, h stands for a length of each of said plurality of nozzles, and L stands for a distance from an end portion of said one or more front surface feed paths that is toward each of said plurality of individual flow paths to each of said plurality of ink droplet ejection units.

9. The inkjet printer according to claim 8, wherein the ink is ejected in a direction approximately perpendicular to a surface of said substrate.

10. An inkjet printer comprising an ink ejection apparatus which includes:

a substrate having one side and another side;

a plurality of nozzles formed in a member provided on said one side of said substrate;

a plurality of ink droplet ejection units, each corresponding to one of said plurality of nozzles, said plurality of ink droplet ejection units being formed on a surface of said one side of the substrate;

a plurality of individual flow paths, each feeding ink to one of said plurality of nozzles, said plurality of individual flow paths being formed on said one side of the substrate;

one or more front surface feed paths for feeding ink correspondingly to said plurality of individual flow paths, said one or more front surface feed paths being formed by etching process from the surface of said one side of the substrate; and one or more back surface feed paths communicating with said one or more front surface feed paths, said one or mote back surface feed paths being formed by sandblast process from a surface of said another side of the substrate, wherein a thickness of said substrate is 600 μm or more and a depth of each of said one or more front surface feed paths is 20 μm to 400 μm.

11. An inkjet printer comprising an ink ejection apparatus which includes:

a substrate having one side and another side;

a plurality of nozzles formed in a member provided on said one side of said substrate; and one or more ink feed paths formed by sandblast process from a surface of said another side of said substrate opposite to said one side on which said plurality of nozzles are located, and formed by etching process from the surface of said one side of said substrate on which said plurality of nozzles are located, a plurality of ink droplet ejection units, each corresponding to each of said plurality of nozzles, said plurality of ink droplet ejection units being formed on the surface of said one side of said substrate on which said plurality of nozzles are located; and a plurality of ink flow paths for feeding ink to each of said plurality of nozzles, said plurality of ink flow paths being defined by one or more partition walls separating said plurality of nozzles from one another, wherein:

said plurality of nozzles are bored in a member laminated on said one or more partition walls;

said one or more ink feed paths comprise one or more first feed paths formed by said etching process in said substrate and one or more second feed paths formed by said sandblast process in said substrate; and an expression:

$$5H+h \geqq L \geqq 2H+h$$

is satisfied while H is 6 μm or less and h is 10 μm or less, wherein H stands for a height of said one or more partition walls, h stands for a length of said plurality of nozzles, and L stands for a length of said one or more first feed paths.

12. A method of manufacturing an inkjet printer comprising and ink ejection apparatus which includes:

a substrate having one side and another side;

a plurality of nozzles formed in a member provided on said one side of said substrate;

a plurality of ink droplet ejection units, each corresponding to one of said plurality of nozzles, said plurality of ink droplet ejection units being formed on a surface of said one side of the substrate;

a plurality of individual flow paths, each feeding ink to one of said plurality of nozzles, said plurality of individual flow paths being formed on said one side of the substrate;

one or more front surface feed pats for feeding ink to said plurality of individual flow paths; and one or more back surface feed paths for feeding ink to said one or more front surface feed paths, wherein:

said plurality of individual flow paths are defined by a plurality of partition walls separating said plurality of nozzles from one another, said plurality of partition walls being formed on said one side of the substrate;

said plurality of nozzles are each bored in a member laminated on said plurality of partition walls; and an expression:

$$5H+h \geqq L \geqq 2H+h$$

is satisfied while H is 6 μm or less and h is 10 μm or less wherein H stands for a height of each of said plurality of partition walls, h stands for a length of each of said plurality of nozzles, and L stands for a distance from an end portion of said one or more front surface feed paths that is toward each of said plurality of individual flow paths to each of said plurality of ink droplet ejection units, said method comprising:

forming said one or more back surface feed paths by sandblast process from a surface of said another side of the substrate; and forming said one or more front surface feed paths by etching process from the surface of said one side of the substrate, thereby making said one or more back surface feed paths and said one or more front surface feed paths communicate with each other through said substrate.

13. The method of manufacturing the injet printer according to claim 12, wherein said one or more front surface feed paths are formed by said etching process after said one or more back surface feed paths are formed by said sandblast process.

14. The method of manufacturing the inkjet printer according to claim 12, wherein said one or more back surface feed paths are formed in said substrate, which is in a grounded state, after said plurality of ink droplet ejection units and driving devices for driving the plurality of ink droplet ejection units are formed in said substrate.

15. A method of manufacturing a liquid ejection apparatus which comprises:

a substrate having one side and another side;

a plurality of nozzles formed in a member provided on said one side of said substrate;

a plurality of droplet ejection units, each corresponding to one of said plurality of nozzles, said plurality of droplet ejection units being formed on a surface of said one side of the substrate;

a plurality of individual flow paths, each feeding liquid to one of said plurality of nozzles, said plurality of individual flow paths being formed on said one side of the substrate;

one or more front surface feed paths for feeding liquid to said plurality of flow paths, and one or more back surface feed paths for feeding liquid to said one or more front surface feed paths, wherein a thickness of said substrate is 600 μm or more and a depth of each of said one or more front surface feed paths is 20 μm to 400 μm, said method comprising:

forming said one or more back surface feed paths by sandblast process from a surface of said another side of the substrate; and forming said one or more front surface feed paths by etching process from the surface of said one side of the substrate, thereby making said one or more back surface feed paths and said one or more front surface feed paths communicate with each other through the substrate.

16. A method of manufacturing an inkjet printer comprising an ink ejection apparatus which includes:

a substrate having one side and another side;

a plurality of nozzles formed in a member provided on said one side of said substrate;

a plurality of ink droplet ejection units, each corresponding to one of said plurality of nozzles, said plurality of ink droplet ejection units being formed on a surface of said one side of the substrate;

a plurality of individual flow paths, each feeding ink to one of said plurality of nozzles, said plurality of individual flow paths being formed on said one side of the substrate;

one or more front surface feed paths for feeding ink to said plurality of flow paths, and one or more back surface feed paths for feeding ink to said one or more front surface feed paths, wherein a thickness of said substrate is 600 μm or more and a depth of each of said one or more front surface feed paths is 20 μm to 400 μm, said method comprising:

forming said one or more back surface feed paths by sandblast process from a surface of said another side of the substrate; and forming said one or more front surface feed paths by etching process from the surface of said one side of the substrate, thereby making said one or more back surface feed paths and said one or more front surface feed paths communicate with each other through the substrate.

17. A liquid ejection apparatus comprising:

a substrate having one side and another side;

a plurality of nozzles formed in a member provided on said one side of said substrate;

a plurality of droplet ejection units, each corresponding to one of said plurality of nozzles, said plurality of droplet ejection units being formed on a surface of said one side of the substrate;

a plurality of individual flow paths, each feeding liquid to one of said plurality of nozzles, said plurality of individual flow paths being formed on said one side of the substrate;

one or more front surface feed paths for feeding liquid correspondingly to said plurality of individual flow paths, said one or more front surface feed paths being formed by etching process from the surface of said one side of the substrate and being of a first accuracy; and one or more back surface feed paths communicating with said one or more front surface feed paths, said one or more back surface feed paths being formed by sandblast process from a surface of said another side or the substrate and being of a second accuracy, said first accuracy being greater than said second accuracy.

18. A liquid ejection apparatus comprising:

a substrate having one side and another side;

a plurality of nozzles formed in a member provided on said one side of said substrate; and one or more liquid feed paths formed by sandblast process, being of a first accuracy, from a surface of said another side of said substrate opposite to said one side on which said plurality of nozzles are located, and formed by etching process, being of a second processing accuracy where said second processing accuracy is greater than said first processing accuracy, from the surface of said one side of said substrate on which said plurality of nozzles are located.

19. A method of manufacturing a liquid ejection apparatus which comprises:

a substrate having one side and another side;

a plurality of nozzles formed in a member provided on said one side of said substrate;

a plurality of droplet ejection units, each corresponding to one of said plurality of nozzles, said plurality of droplet ejection units being formed on a surface of said one side of the substrate;

a plurality of individual flow paths for feeding liquid to one of said plurality of nozzles, said plurality of individual flow paths being formed on said one side of the substrate;

one or more front surface feed paths for feeding liquid to said one or more front surface feed paths, said method comprising:

forming said one or more back surface feed paths by sandblast process from a surface of said another side of the substrate and being of first production yield and of first processing accuracy; and forming said one or more front surface feed paths by etching process from the surface of said one side of the substrate, thereby making said one or more back surface feed paths and said one or more front surface feed paths communicate with each other through said substrate and being of second production yield and second processing accuracy said first production yield being greater than said second production yield and said second processing accuracy being greater than said first processing accuracy.

20. An inkjet printer comprising an ink ejection apparatus which includes:

a substrate having one side and another side;

a plurality of nozzles formed in a member provided on said one side of said substrate;

a plurality of ink droplet ejection units, each corresponding to one of said plurality of nozzles, said plurality of ink droplet ejection units being formed on a surface of said one side of the substrate;

a plurality of individual flow paths, each feeding ink to one of said plurality of nozzles, said plurality of individual flow paths being formed on said one side of the substrate;

one or more front surface feed paths for feeding ink correspondingly to said plurality of individual flow paths, said one or more front surface feed paths being formed by etching process from the surface of said one side of the substrate and being of a first processing accuracy; and one or more back surface feed paths communicating with said one or more front surface feed paths, said one or mote back surface feed paths being formed by sandblast process from a surface of said another side of the substrate and being of a second processing accuracy said first processing accuracy being greater than said second processing accuracy.

21. An inkjet printer comprising an ink ejection apparatus which includes:

a substrate having one side and another side;

a plurality of nozzles formed in a member provided on said one side of said substrate; and one or more ink feed paths formed by sandblast process, being of first processing accuracy and first production yield, from a surface of said another side of said substrate opposite to said one side on which said plurality of nozzles are located, and formed by etching process, being of second processing accuracy and second production yield said second processing accuracy being greater than said first processing accuracy and first production yield being greater than second production yield, from the surface of said one side of said substrate on which said plurality of nozzles are located.

22. A method of manufacturing an inkjet printer comprising and ink ejection apparatus which includes:

a substrate having one side and another side;

a plurality of nozzles formed in a member provided on said one side of said substrate;

a plurality of ink droplet ejection units, each corresponding to one of said plurality of nozzles, said plurality of ink droplet ejection units being formed on a surface of said one side of the substrate;

a plurality of individual flow paths, each feeding ink to one of said plurality of nozzles, said plurality of individual flow paths being formed on said one side of the substrate;

one or more front surface feed pats for feeding ink to said plurality of individual flow paths; and one or more back surface feed paths for feeding ink to said one or more front surface feed paths, said method comprising:

forming said one or more back surface feed paths by sandblast process from a surface of said another side of the substrate and being of a first processing accuracy; and forming said one or more front surface feed paths by etching process from the surface of said one side of the substrate and being of a second processing accuracy said second processing accuracy being greater than said first processing accuracy, thereby making said one or more back surface feed paths and said one or more front surface feed paths communicate with each other through said substrate.

* * * * *

UNITED STATES PATENT AND TRADEMARK OFFICE

CERTIFICATE OF CORRECTION

PATENT NO. : 6,749,289 B2
DATED : June 15, 2004
INVENTOR(S) : Nobuo Matsumoto and Masao Mitani It is certified that error appears in the above-identified patent and that said Letters Patent is hereby corrected as shown below:

Column 26,
Lines 1 and 46, change “mote” to -- more --.
Line 1, after “being” delete “,”.

Column 27,
Line 34, change “pats” to -- paths --.
Line 66, change “injet” to -- inkjet --.

Column 29,
Line 63, after “accuracy” insert -- , --.

Column 30,
Line 22, change “mote” to -- more --.
Line 58, change “pats” to -- paths --.

Column 31,
Line 4, after “racy” delete “,”.

Signed and Sealed this

Eighth Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,749,289 B2
DATED : June 15, 2004
INVENTOR(S) : Matsumoto et al.

It is certified that error appears in the above-identified patent and that said Letters Patent is hereby corrected as shown below:

Column 31,
Line 4, after “racy” insert -- , --.

Signed and Sealed this

Thirty-first Day of May, 2005

JON W. DUDAS
*Director of the United States Patent and Trademark Office*